US009499246B2

(12) United States Patent
Shoemaker et al.

(10) Patent No.: US 9,499,246 B2
(45) Date of Patent: Nov. 22, 2016

(54) PADDLE ASSEMBLY

(71) Applicant: Scott D. Shoemaker, Poway, CA (US)

(72) Inventors: Scott D. Shoemaker, Poway, CA (US); Thomas Preece, San Diego, CA (US); Robert R. Lang, San Diego, CA (US); Charles Jamedson Glynn, Carlsbad, CA (US)

(73) Assignee: Scott D. Shoemaker, Poway, CA (US)

( * ) Notice: Subject to any disclaimer, the term of this patent is extended or adjusted under 35 U.S.C. 154(b) by 0 days.

(21) Appl. No.: 14/683,783

(22) Filed: Apr. 10, 2015

(65) Prior Publication Data

US 2015/0291268 A1 Oct. 15, 2015

Related U.S. Application Data

(60) Provisional application No. 62/024,876, filed on Jul. 15, 2014, provisional application No. 61/978,043, filed on Apr. 10, 2014.

(51) Int. Cl.
*B63H 16/04* (2006.01)

(52) U.S. Cl.
CPC ..... *B63H 16/04* (2013.01)

(58) Field of Classification Search
CPC ..... B63H 16/04
USPC ..... 440/101, 102, 105
See application file for complete search history.

(56) References Cited

U.S. PATENT DOCUMENTS

| | | | | |
|---|---|---|---|---|
| 4,701,142 | A | 10/1987 | Merritt | |
| 6,027,386 | A | 2/2000 | Hains et al. | |
| 6,210,244 | B1 | 4/2001 | Nordby | |
| 8,100,733 | B1 | 1/2012 | Ross et al. | |
| 8,192,242 | B2 | 6/2012 | Luecker et al. | |
| 8,317,558 | B2 | 11/2012 | Bucknell et al. | |
| D680,941 | S | 4/2013 | Deppen | |
| 8,632,371 | B1 | 1/2014 | Ramsey | |
| 2002/0058448 | A1 * | 5/2002 | Hibler | B63H 16/04 440/102 |
| 2005/0101200 | A1 | 5/2005 | Townsend | |
| 2005/0153606 | A1 | 7/2005 | Lane et al. | |
| 2005/0227554 | A1 | 10/2005 | Hevesi et al. | |
| 2007/0224894 | A1 | 9/2007 | Kudrna | |
| 2009/0004939 | A1 | 1/2009 | Branovitz | |
| 2012/0028518 | A1 | 2/2012 | Steinhour | |
| 2013/0045099 | A1 | 2/2013 | Bicknell | |
| 2013/0122761 | A1 | 5/2013 | MacIas | |
| 2013/0330190 | A1 | 12/2013 | Kicker | |
| 2014/0017963 | A1 | 1/2014 | Lazarovits | |

* cited by examiner

*Primary Examiner* — Lars A Olson
(74) *Attorney, Agent, or Firm* — Roeder & Broder, LLP; James P. Broder

(57) ABSTRACT

A paddle assembly includes a tubular shaft that is configured to be coupled to a blade of the paddle assembly. The shaft has a shaft length, a first flexural rigidity at a first location along the shaft length and a second flexural rigidity at a second location along the shaft length. The ratio of the first flexural rigidity to the second flexural rigidity can be at least approximately 1.20. The shaft is substantially linear along the shaft length. The shaft has a shaft midpoint. The first location and the second location are substantially equidistant from and on opposite sides of the shaft midpoint. The shaft can have a tubular configuration. The shaft has a plurality of layers of material at each of the first location and the second location. The orientation of the layers of material at the first location is different than the orientation of materials at the second location. A modulus of elasticity of the materials used to form the shaft varies along the shaft length. The shaft can be formed at least partially from carbon fiber materials.

27 Claims, 25 Drawing Sheets

1218

1218

1218

1218

1210
12D
12E
1264
12F
1218
12G 1210
1264
1266
1218

1210
1218
1264

| Force (Lbs) | Location (x) | Deflection (y) | EI |
|---|---|---|---|
| 30 | 14 | 0.0553 | 248101.2658 |
| 30 | 16 | 0.0564 | 243262.4113 |
| 30 | 18 | 0.0533 | 257410.8818 |
| 30 | 20 | 0.0535 | 256448.5981 |
| 30 | 22 | 0.0535 | 256448.5981 |
| 30 | 24 | 0.0537 | 255493.4823 |
| 30 | 26 | 0.0565 | 242831.8584 |
| 30 | 28 | 0.0551 | 249001.8149 |
| 30 | 30 | 0.0582 | 235738.8316 |
| 30 | 32 | 0.0630 | 217777.7778 |
| 30 | 34 | 0.0689 | 199129.1727 |
| 30 | 36 | 0.0768 | 178645.8333 |
| 30 | 38 | 0.0844 | 162559.2417 |
| 30 | 40 | 0.0904 | 151769.9115 |
| 30 | 42 | 0.0924 | 148484.8485 |
| 30 | 44 | 0.0953 | 143966.4218 |
| 30 | 46 | 0.0968 | 141735.5372 |
| 30 | 48 | 0.1015 | 135172.4138 |
| 30 | 50 | 0.1046 | 131166.3480 |

FIG. 19A

| Force (Lbs) | Location (x) | Deflection (y) | EI |
|---|---|---|---|
| 30 | 14 | 0.0615 | 223089.4309 |
| 30 | 16 | 0.0615 | 223089.4309 |
| 30 | 18 | 0.0613 | 223817.292 |
| 30 | 20 | 0.0614 | 223453.7687 |
| 30 | 22 | 0.0614 | 223453.7687 |
| 30 | 24 | 0.0613 | 223817.292 |
| 30 | 26 | 0.0629 | 218124.0064 |
| 30 | 28 | 0.0647 | 212055.6414 |
| 30 | 30 | 0.0675 | 203259.2593 |
| 30 | 32 | 0.0740 | 185405.4054 |
| 30 | 34 | 0.0843 | 162752.0759 |
| 30 | 36 | 0.0954 | 143815.5136 |
| 30 | 38 | 0.1060 | 129433.9623 |
| 30 | 40 | 0.1152 | 119097.2222 |
| 30 | 42 | 0.1216 | 112828.9474 |
| 30 | 44 | 0.1260 | 108888.8889 |
| 30 | 46 | 0.1261 | 108802.5377 |
| 30 | 48 | 0.1278 | 107355.2426 |
| 30 | 50 | 0.1295 | 105945.9459 |

FIG. 19B

| Force (Lbs) | Location (x) | Deflection (y) | EI |
|---|---|---|---|
| 30 | 14 | 0.0597 | 229815.7454 |
| 30 | 16 | 0.0596 | 230201.3423 |
| 30 | 18 | 0.0597 | 229815.7454 |
| 30 | 20 | 0.0585 | 234529.9145 |
| 30 | 22 | 0.0581 | 236144.5783 |
| 30 | 24 | 0.0600 | 228666.6667 |
| 30 | 26 | 0.0595 | 230588.2353 |
| 30 | 28 | 0.0597 | 229815.7454 |
| 30 | 30 | 0.0628 | 218471.3376 |
| 30 | 32 | 0.0677 | 202658.7888 |
| 30 | 34 | 0.0739 | 185656.2923 |
| 30 | 36 | 0.0814 | 168550.3686 |
| 30 | 38 | 0.0967 | 141882.1096 |
| 30 | 40 | 0.1000 | 137200 |
| 30 | 42 | 0.1063 | 129068.6736 |
| 30 | 44 | 0.1061 | 129311.9698 |
| 30 | 46 | 0.1062 | 129190.2072 |
| 30 | 48 | 0.1107 | 123938.5727 |
| 30 | 50 | 0.1107 | 123938.5727 |

FIG. 19C

| Force (Lbs) | Location (x) | Deflection (y) | EI |
|---|---|---|---|
| 30 | 14 | 0.0583 | 235334.4768 |
| 30 | 16 | 0.0582 | 235738.8316 |
| 30 | 18 | 0.0565 | 242831.8584 |
| 30 | 20 | 0.0584 | 234931.5068 |
| 30 | 22 | 0.0564 | 243262.4113 |
| 30 | 24 | 0.0566 | 242402.8269 |
| 30 | 26 | 0.0565 | 242831.8584 |
| 30 | 28 | 0.0595 | 230588.2353 |
| 30 | 30 | 0.0601 | 228286.1897 |
| 30 | 32 | 0.0628 | 218471.3376 |
| 30 | 34 | 0.0689 | 199129.1727 |
| 30 | 36 | 0.0785 | 174777.0701 |
| 30 | 38 | 0.0892 | 153811.6592 |
| 30 | 40 | 0.0936 | 146581.1966 |
| 30 | 42 | 0.0968 | 141735.5372 |
| 30 | 44 | 0.0970 | 141443.299 |
| 30 | 46 | 0.0988 | 138866.3968 |
| 30 | 48 | 0.0986 | 139148.073 |
| 30 | 50 | 0.1012 | 135573.1225 |

FIG. 19D

PADDLE ASSEMBLY

BACKGROUND

Watersports have been extremely popular for decades. In recent years, a relatively new type of watersport has become increasingly more widespread, which involves standing on top of a large board similar to a surfboard (known as a "stand-up paddleboard" or simply a "paddleboard"). A paddleboarder typically uses a paddle having a single blade on one end in order to propel the user and the paddleboard along the surface of the water. Paddleboarding can include racing against other paddleboarders, racing against the clock, long distance paddleboarding, or recreational paddleboarding, as examples.

Currently, paddles are available with shafts that come in a variety of lengths, and blades having various different shapes and sizes. The optimal paddle for any one user can be determined based on the user's height, weight, strength, ability, age, competitiveness and desired usage, to name just a few factors. Further, the ideal paddle for a user can also depend upon the type of waterway or body of water, the water conditions, weather conditions, etc. Because paddles can be somewhat costly, having an arsenal of paddles with different characteristics to suit numerous conditions may not be practical for everyone. In addition, as paddleboarding has become more and more competitive, the need for a lightweight, strong paddle that produces greater paddling efficiency or a competitive advantage has also increased.

SUMMARY

Various embodiments of the present invention are directed toward a paddle assembly that includes a shaft. The shaft is configured to be coupled to a blade of the paddle assembly. The shaft has a shaft length, a first flexural rigidity (EI) at a first location along the shaft length and a second flexural rigidity (EI) at a second location along the shaft length. In one embodiment, the ratio of the first flexural rigidity to the second flexural rigidity is at least approximately 1.20.

In some embodiments, the shaft can be substantially linear along the shaft length. In one embodiment, the shaft can have a shaft midpoint along the shaft length, and the first location and the second location can be substantially equidistant from the shaft midpoint. In certain embodiments, the first location and the second location are positioned on opposite sides of the shaft midpoint from one another.

The shaft can have a tubular configuration. In some such embodiments, the first location can have a first inner diameter and the second location can have a second inner diameter that is less than 10 percent different than the first inner diameter. Additionally, or in the alternative, the first location can have a first outer diameter and the second location can have a second outer diameter that is less than 10 percent different than the first outer diameter.

In some embodiments, the shaft can include a plurality of layers of material at each of the first location and the second location. In certain embodiments, the orientation of the layers of material at the first location is different than the orientation of materials at the second location. The shaft can include a plurality of layers of material that change along the shaft length. In one embodiment, a modulus of elasticity of the materials used to form the shaft varies along the shaft length.

In one embodiment, the ratio of the first flexural rigidity to the second flexural rigidity can be at least approximately 1.50. In various embodiments, the change in the flexural rigidity of the shaft can occur gradually along the shaft length.

In some embodiments, the shaft can be formed at least partially from carbon fiber materials.

In certain embodiments, the shaft includes a shaft midpoint along the shaft length, a shaft first half and a shaft second half on opposite sides of the shaft midpoint. In some such embodiments, the shaft first half can be configured to be positioned more proximate to a blade of the paddle assembly than the shaft second half, and an average flexural rigidity of the shaft first half is at least approximately 10 percent different than an average flexural rigidity of the shaft second half. In one embodiment, the average flexural rigidity of the shaft first half is at least approximately 10 percent greater than the average flexural rigidity of the shaft second half.

The present invention is also directed toward a method for manufacturing the paddle assembly.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which:

FIG. 19A is a table showing deflection and EI as a function of location and load on one embodiment of the shaft, corresponding to curve 19A in FIG. 18;

FIG. 19B is a table showing deflection and EI as a function of location and load on another embodiment of the shaft, corresponding to curve 19B in FIG. 18;

FIG. 19C is a table showing deflection and EI as a function of location and load on yet another embodiment of the shaft, corresponding to curve 19C in FIG. 18;

FIG. 19D is a table showing deflection and EI as a function of location and load on still another embodiment of the shaft, corresponding to curve 19D in FIG. 18;

FIG. 21D1 is a side view of a portion of the paddle assembly including a blade that is adjustable relative to the shaft, the blade being illustrated in a first position;

FIG. 21D2 is a side view of the portion of the paddle assembly illustrated in FIG. 23D1, the blade being illustrated in a second position;

FIG. 21D3 is a side view of the portion of the paddle assembly illustrated in FIG. 23D1, the blade being illustrated in a third position;

DESCRIPTION

Embodiments of the present invention are described herein in the context of a paddle assembly. Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings. The same or similar reference indicators will be used throughout the drawings and the following detailed description to refer to the same or like parts.

In the interest of clarity, not all of the routine features of the implementations described herein are shown and described. It is, of course, appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it is recognized that such a development effort might be complex and time-consuming, but would nevertheless be a routine undertaking of engineering for those of ordinary skill in the art having the benefit of this disclosure.

The paddle assembly illustrated and described herein can include any general type of paddle that is used to propel or steer a user along or within a waterway or other body of water (hereinafter the "water"). For example, although the paddle assembly shown and described herein is particularly useful as a single-bladed paddle, many or all of the features illustrated and described could be utilized on a double-bladed paddle as well. For ease of discussion, only a single-bladed paddle will be shown and described herein, although those skilled in the art would understand that the features taught herein could be equally applicable to other types of paddles.

Figure 1:
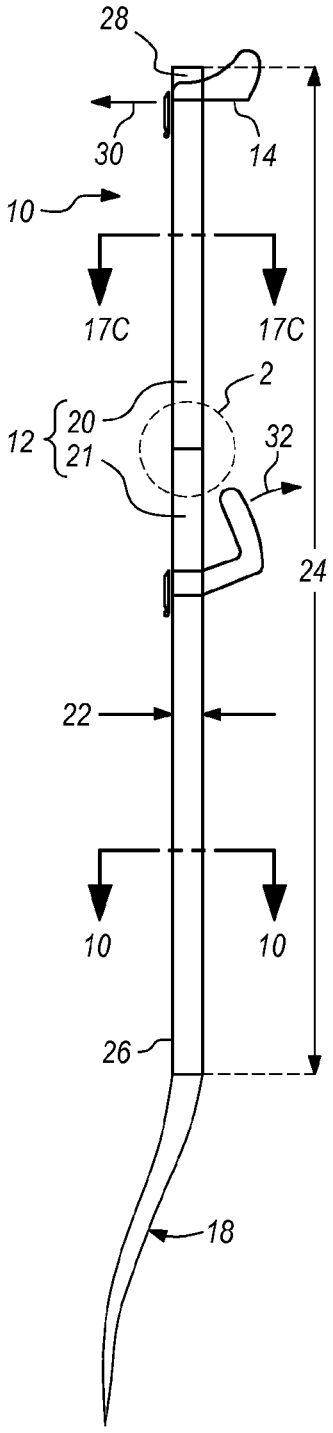
FIG. 1 is a side view of one embodiment of a paddle assembly having features of the present invention.

FIG. 1 is a side view of one embodiment of a paddle assembly 10. In this embodiment, the paddle assembly 10 includes a shaft assembly 12, a first handle assembly 14 (also sometimes referred to herein as an "upper handle assembly"), a second handle assembly 16 (also sometimes referred to herein as a "lower handle assembly") and a blade assembly 18. The various components of the paddle assembly 10 described herein can be formed from a variety of different materials, such as composite materials, plastics, metals, rubber compounds, carbon fiber, nano materials such as graphene, carbon nanotubes (CNT's), vertically aligned carbon nanotubes (VCNT's), or other nano materials, and/or any combination thereof. Additionally and/or alternatively, the various components of the paddle assembly 10 can be formed from other suitable materials.

In the embodiment illustrated in FIG. 1, the shaft assembly 12 supports and/or is connected and/or coupled to the handle assemblies 14, 16, and the blade assembly 18. The design of the shaft assembly 12 can be varied. The shaft assembly 12 includes a shaft 19. The shaft 19 can include a one or more shaft members. For example, in the embodiment illustrated in FIG. 1, the shaft assembly 12 includes a first shaft member 20 and a second shaft member 21 for ease in understanding only, although the shaft assembly 12 can include any suitable number of shaft members, e.g., greater than two. In addition, any of the shaft members 20, 21, can be referred to herein as the "first shaft member" or the "second shaft member", etc. The shaft members 20, 21 can be removably secured to one another such as by threads, friction, or by any other suitable method. In an alternative embodiment, the shaft assembly 12 can be integrally formed as a one-piece, unitary structure. Further, the shaft assembly 12 can have a shaft width 22 that can be relatively consistent along a shaft length 24 the shaft. Alternatively, the shaft assembly 12 can have a shaft width 22 that varies along the shaft length 24.

In certain embodiments, the shaft width 22 and/or the flexibility of the shaft can vary along the shaft length 24 of the shaft assembly 12. Additionally and/or alternatively, the configuration of a cross-section of the shaft assembly 12 can vary along the shaft length 24. This can be accomplished in various ways, such as by altering the shaft width 22, altering the composition, e.g., materials, of the shaft assembly 12 along the shaft length 24, altering the configuration, geometry and/or thickness of a cross-section, e.g., the walls, of the shaft assembly 12 along the shaft length 24, varying the weight of the shaft assembly 12 along the shaft length 24, or by other suitable methods.

The shaft assembly 12 has a shaft first end 26 (also sometimes simply referred to herein as the "first end") and a shaft second end 28 (also sometimes simply referred to herein as the "second end"). In certain embodiments, the first end 26 can be positioned at or near the blade assembly 18 of a single-bladed paddle assembly 10, and the second end 28 can be positioned at or near an opposite end (away from the blade assembly 18) of the shaft assembly 12 from the first end 26. However, as used herein, either end of the shaft can be the first end 26 or the second end 28. As provided in greater detail herein, in certain embodiments, the flexibility of the shaft assembly 12 can change along the shaft length 24.

In the embodiment illustrated in FIG. 1, the first handle assembly 14 is positioned at or near the second end 28 of the shaft assembly 12. Further, in this embodiment, the second handle assembly 16 is positioned nearer the blade 18 than the first handle assembly 14. It is recognized, however, that either handle assembly 14, 16, can be referred to as the "first handle assembly" or the "second handle assembly", or simply as the "handle assembly".

A user grips or otherwise holds the handle assemblies 14, 16 during use of the paddle assembly 10 by positioning a first hand of the user on the first handle assembly 14 and a second hand of the user on the second handle assembly 16. Periodically, the user typically reverses these hand positions. During use, the user exerts a first force in general directly of arrow 30 (typically a "push") on the first handle assembly 14 during a paddle stroke. Further, the user substantially simultaneously exerts a second force in general direction of arrow 32 (typically a "pull") on the second handle assembly 16 during the same paddle stroke. In so doing, the blade 18 is moved through the water in such a way as to propel the board and the user along the water.

Figure 2A:
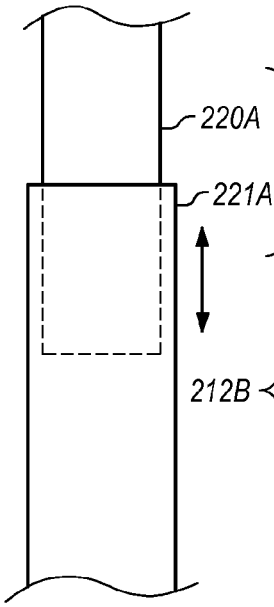
FIG. 2A is a side view of one embodiment of a shaft of the paddle assembly.

FIG. 2A is a side view of one embodiment of a portion of a shaft assembly 212A, such as that illustrated in dashed circle 2 in FIG. 1. In this embodiment, the shaft assembly 212A is "telescoping" such that the first shaft member 220A is at least partially inserted into the second shaft member 221A. In this manner, the overall shaft length 24 (illustrated in FIG. 1) of the shaft assembly 212A can be adjustable. It is recognized that the dashed circle 2 in FIG. 1 can be located anywhere along the entire length 24 of the shaft assembly 12. It is further understood that the shaft assembly 12 can include greater than one location in which the first shaft member 220A is at least partially inserted into the second shaft member 221A. By only illustrating one such location in FIG. 1, no intent to limit the invention to just one telescoping location is intended or implied.

The first shaft member 220A and the second shaft member 221A can be removably secured together in a number of different ways. In one embodiment, one or both of the shaft members 220A, 221A can be threaded. In another embodiment, one or both of the shaft members 220A, 221A can be tapered so that the shaft members 220A, 221A are held together by friction. In another embodiment, a locking mechanism (not illustrated in FIG. 2A) can be used to removably secure the shaft members 220A, 221A together.

In another embodiment, one of the shaft members 220A, 221A, can be substituted by the blade assembly 18 (illustrated in FIG. 1). In other words, the blade assembly 18 can act in a similar manner to one of the shaft members 220A, 221A, and can be telescopingly connected to one of the shaft members 220A, 221A. For example, the blade assembly 18 can be partially inserted into the second shaft member 221A (or the first shaft member 220A). Conversely, the second shaft member 221A (or the first shaft member 220A) can be partially inserted into the blade assembly 18.

Depending upon the positioning of the one or more connections between the various shaft members 220A, 221A, the location of the handle assemblies 14, 16, and the location of the blade assembly 18, a greater level of adjustability is provided. For example, in one embodiment, the upper handle assembly 14 is adjustable relative to the lower handle assembly 16 and the blade assembly 18. In another embodiment, the upper handle assembly 14 and the lower handle assembly 16 are adjustable relative to the blade assembly 18. In yet another embodiment, the upper handle assembly 14 and the blade assembly 18 are adjustable relative to the lower handle assembly 16, etc.

Figure 2B:
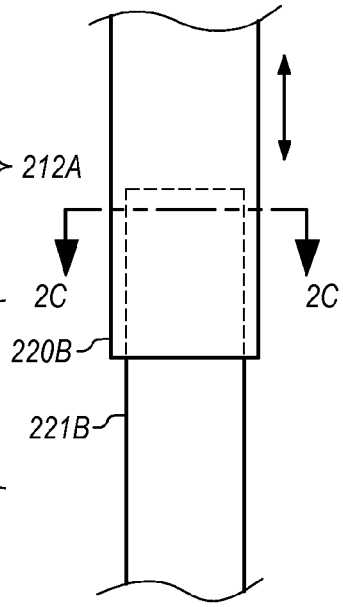
FIG. 2B is a side view of another embodiment of the shaft of the paddle assembly.

FIG. 2B is a side view of another embodiment of a portion of a shaft assembly 212B, such as that illustrated in dashed circle 2 in FIG. 1. In this embodiment, the shaft assembly 212B is "telescoping" such that the second shaft member 221B is at least partially inserted into the first shaft member 220B. In this manner, the overall shaft length 24 (illustrated in FIG. 1) of the shaft assembly 212B is adjustable. Again, it is recognized that the dashed circle 2 in FIG. 1 can be located anywhere along the entire length 24 of the shaft assembly 12, and even including the blade assembly 18 as described above. It is further understood that the shaft assembly 12 can include greater than one location in which the second shaft member 221B is at least partially inserted into the first shaft member 220B. By only illustrating one such location in FIG. 1, no intent to limit the invention to just one telescoping location is intended or implied. It is further recognized that the telescoping shaft members from the embodiment illustrated in FIGS. 2A and 2B can be combined in an alternative embodiment. The first shaft member 220B and the second shaft member 221B can be removably secured together in one of the manners previously described herein.

Figure 2C:
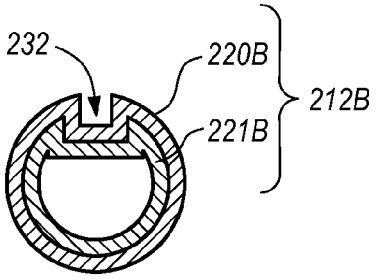
FIG. 2C is a cross-sectional view of the shaft taken on line 2C-2C in FIG. 2B.

FIG. 2C is a cross-sectional view of one embodiment of the shaft assembly 212B taken on line 2C-2C in FIG. 2B. In this embodiment, the first shaft member 220B and the second shaft member 221B each has a complementary notch 232 so that the shaft members 220B, 221B interlock with one another. In other words, the shaft members 220B, 221B are inhibited from rotating relative to one another, which could otherwise result in misalignment of the blade assembly 18 (illustrated in FIG. 1) relative to the handle assemblies 14, 16 (illustrated in FIG. 1) during paddling. The notch 232 can have any shape or configuration provided that the shaft members 220B, 221B fit together in a complementary manner to inhibit rotation of one of the shaft members 220B, 221B relative to the other shaft member 220B, 221B.

Figure 3A:
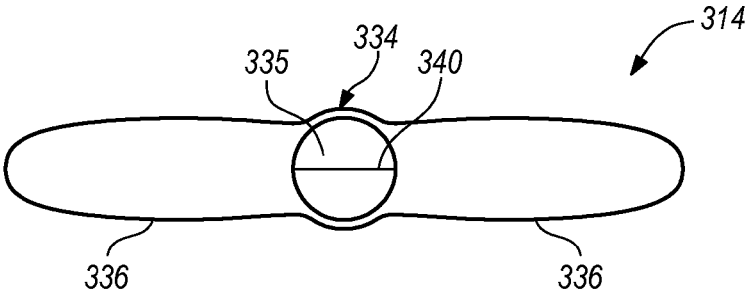
FIG. 3A is a top view of one embodiment of an upper handle assembly of the paddle assembly.
Figure 3B:
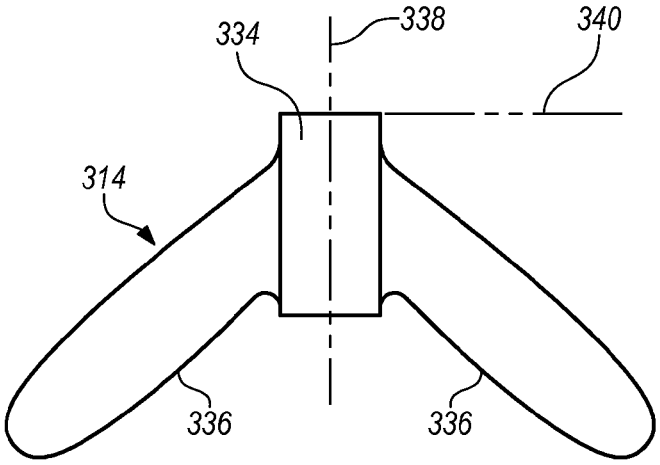
FIG. 3B is a front view of the upper handle assembly illustrated in FIG. 3A.
Figure 3C:
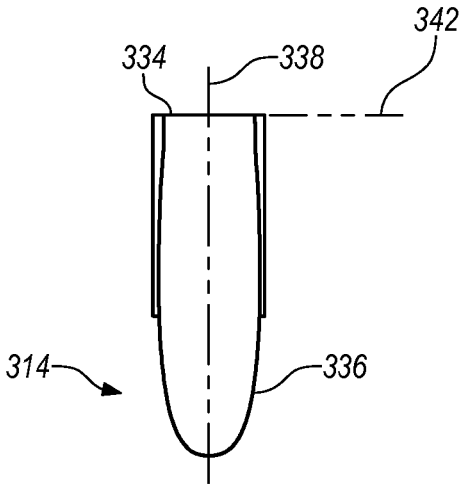
FIG. 3C is a side view of the upper handle assembly illustrated in FIG. 3A.

FIGS. 3A-3C illustrate various views of one embodiment of an upper handle assembly 314. In this embodiment, the upper handle assembly 314 includes a shaft receiver 334 and one or more upper handles 336 on either side of the shaft receiver 334. The shaft receiver 334 includes a shaft aperture 335 that receives the shaft assembly 12 (illustrated in FIG. 1).

In the embodiment illustrated in FIGS. 3A-3C, the upper handle assembly 314 includes two upper handles 336 that are symmetrical relative to a longitudinal axis 338 of the shaft assembly 12 in a first direction 340 and a second direction 342 that is substantially perpendicular to the first direction 340. Further, in one embodiment, the upper handles 336 are somewhat downwardly depending, e.g. toward the blade assembly 18 (illustrated in FIG. 1) when positioned on the shaft assembly 12. However, in alternative embodiments, the upper handles 336 can be upwardly depending, e.g. away from the blade assembly 18, or substantially flat, e.g. neither toward nor away from the blade assembly 18. Further, the upper handle assembly 314 can include fewer or greater than two handles 336.

Figure 4A:
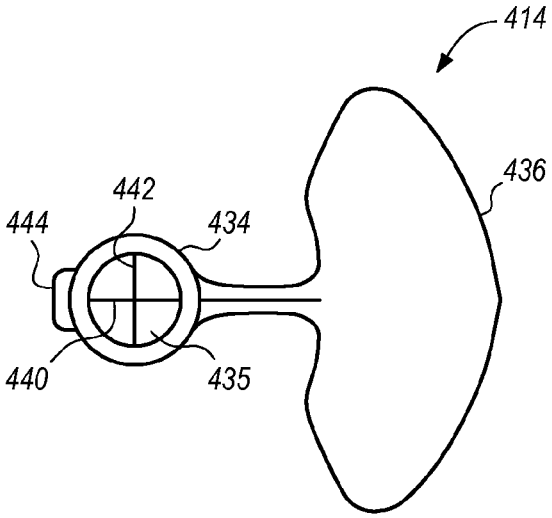
FIG. 4A is a top view of another embodiment of the upper handle assembly of the paddle assembly.
Figure 4B:
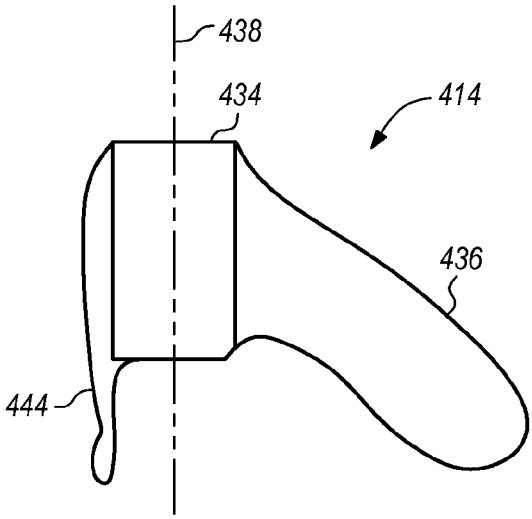
FIG. 4B is a side view of the upper handle assembly illustrated in FIG. 4A.
Figure 4C:
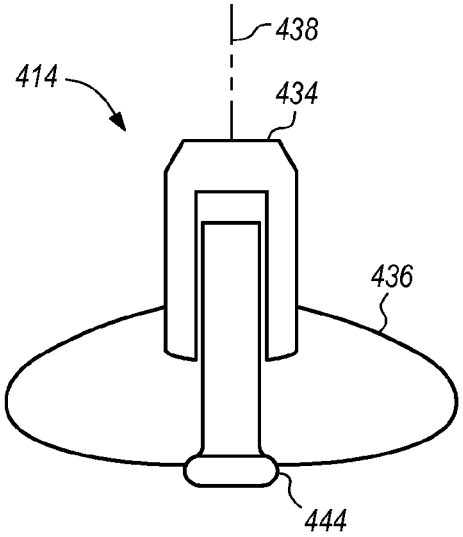
FIG. 4C is a rear view of the upper handle assembly illustrated in FIG. 4A.
Figure 4D:
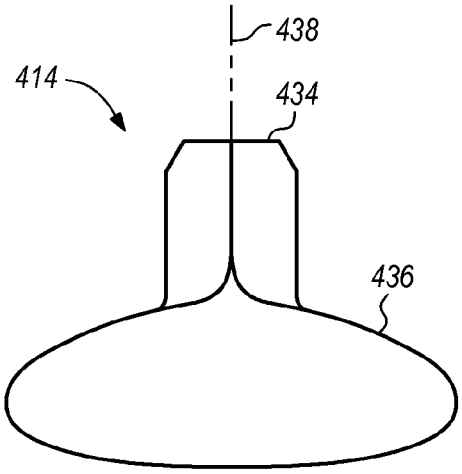
FIG. 4D is a front view of the upper handle assembly illustrated in FIG. 4A.
Figure 5A:
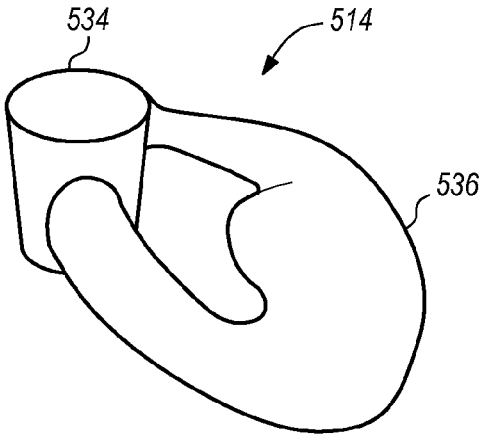
FIG. 5A is a side perspective view of yet another embodiment of the upper handle assembly of the paddle assembly.
Figure 5B:
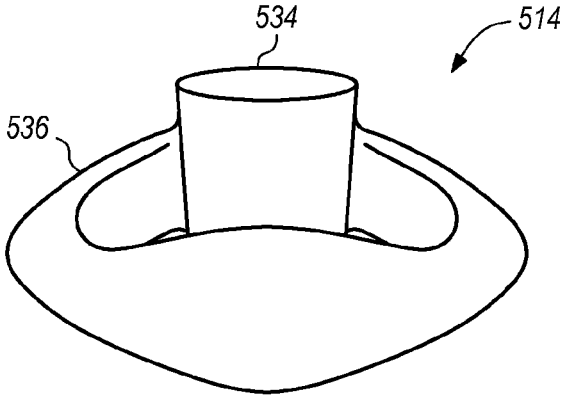
FIG. 5B is a front perspective view of the upper handle assembly illustrated in FIG. 5A.
Figure 5C:
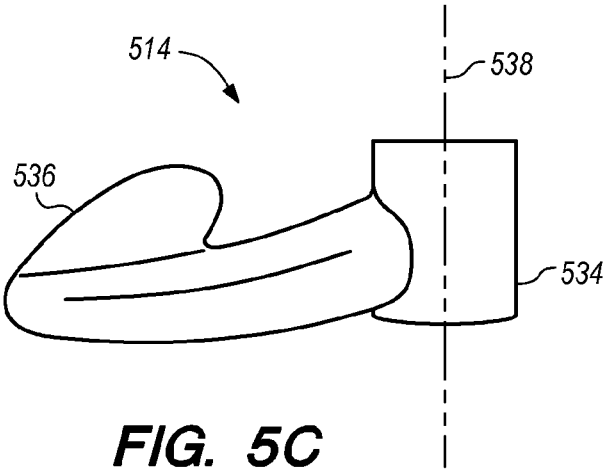
FIG. 5C is a side view of the upper handle assembly illustrated in FIG. 5A.
Figure 5D:
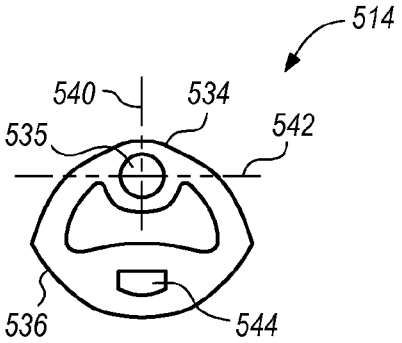
FIG. 5D is a bottom view of the upper handle assembly illustrated in FIG. 5A.

In certain embodiments, the upper handle assembly 314 can also include one or more first locking mechanisms 444 (illustrated in FIGS. 4A-4C) that secure the upper handle assembly 314 onto the shaft assembly 12 to inhibit any movement of the upper handle assembly 314 relative to the shaft assembly 12 during use.

FIGS. 4A-4D illustrate various views of another embodiment of an upper handle assembly 414. In this embodiment, the upper handle assembly 414 includes a shaft receiver 434 and one or more upper handles 436 on either side of the shaft receiver 434. The shaft receiver 434 includes a shaft aperture 435 that receives the shaft assembly 12 (illustrated in FIG. 1).

In the embodiment illustrated in FIGS. 4A-4D, the upper handle assembly 414 includes an upper handle 436 that extends away from the shaft receiver 434. In one embodiment, the upper handle 436 is symmetrical relative to a longitudinal axis 438 of the shaft assembly 12 in a first direction 440 but not in a second direction 442 that is substantially perpendicular to the first direction 440. The specific shape of the upper handle 436 can vary to suit the design requirements of the upper handle assembly 414 and the paddle assembly 10. Further, in one embodiment, the upper handle 436 can be somewhat downwardly depending, e.g. toward the blade assembly 18 (illustrated in FIG. 1) when positioned on the shaft assembly 12. However, in alternative embodiments, the upper handle 436 can be upwardly depending, e.g. away from the blade assembly 18, or substantially flat, e.g. neither toward nor away from the blade assembly 18.

In one embodiment, the upper handle assembly 414 can also include one or more first locking mechanisms 444 that secure the upper handle assembly 414 onto the shaft assembly 12 to inhibit any movement of the upper handle assembly 414 relative to the shaft assembly 12 during use. The first locking mechanism 444 can be quick release cam-type mechanism, or can include any other suitable type of mechanism known to those skilled in the art that will selectively releasably secure and/or lock the upper handle assembly 414 to the shaft. In one embodiment, the first locking mechanism 444 can be operated "on the fly" so that a user can easily adjust the position of the upper handle assembly 414 relative to the shaft assembly 12 during use, i.e. while paddling on the water. By releasing the locking mechanism 444, the user can adjust the upper handle assembly 414 either upwardly (away from the blade assembly 18) or downwardly (toward the blade assembly 18) on the shaft assembly 12, and/or rotationally, e.g. about the shaft assembly 12.

However, in various embodiments, once the locking mechanism 444 is locked so that the upper handle assembly 414 is secured to the shaft assembly 12, the upper handle assembly is basically immovable relative to the portion of the shaft assembly 12 to which the upper handle assembly 414 is secured. In other words, in these various embodiments, once the upper handle assembly 414 is in the locked position, the upper handle assembly 414 will not rotate about the shaft assembly 12 or move along the shaft assembly 12.

FIG. 5A-5D illustrate various views of another embodiment of an upper handle assembly 514. In this embodiment, the upper handle assembly 514 includes a shaft receiver 534 and one or more upper handles 536 on either side of the shaft receiver 534. The shaft receiver 534 includes a shaft aperture 535 that receives the shaft assembly 12 (illustrated in FIG. 1).

In the embodiment illustrated in FIGS. 5A-5D, the upper handle assembly 514 includes an upper handle 536 that extends away in two directions from the shaft receiver 534. In one embodiment, the upper handle 536 is symmetrical relative to a longitudinal axis 538 of the shaft assembly 12 in a first direction 540 but not in a second direction 542 that is substantially perpendicular to the first direction 540. The specific shape of the upper handle 536 can vary to suit the design requirements of the upper handle assembly 514 and the paddle assembly 10. Further, in one embodiment, the upper handle 536 can be somewhat downwardly depending, e.g. toward the blade assembly 18 (illustrated in FIG. 1) when positioned on the shaft assembly 12. However, in alternative embodiments, the upper handle 536 can be upwardly depending, e.g. away from the blade assembly 18, or substantially flat, e.g. neither toward nor away from the blade assembly 18.

In one embodiment, the upper handle assembly 514 can also include one or more first locking mechanisms 544 that secure the upper handle assembly 514 onto the shaft assembly 12 to inhibit any movement of the upper handle assembly 514 relative to the shaft assembly 12 during use. The first locking mechanism 544 can be push-button, quick release mechanism, or can include any other suitable type of mechanism known to those skilled in the art that will releasably secure the upper handle assembly 514 to the shaft assembly 12. In one embodiment, the first locking mechanism 544 can be operated "on the fly" so that a user can easily adjust the position of the upper handle assembly 514 relative to the shaft assembly 12 during use, i.e. while paddling on the water. By releasing the locking mechanism 544, the user can adjust the upper handle assembly 514 either upwardly (away from the blade assembly 18) or downwardly (toward the blade assembly 18) on the shaft assembly 12, and/or rotationally, e.g. about the shaft assembly 12.

Figure 6:
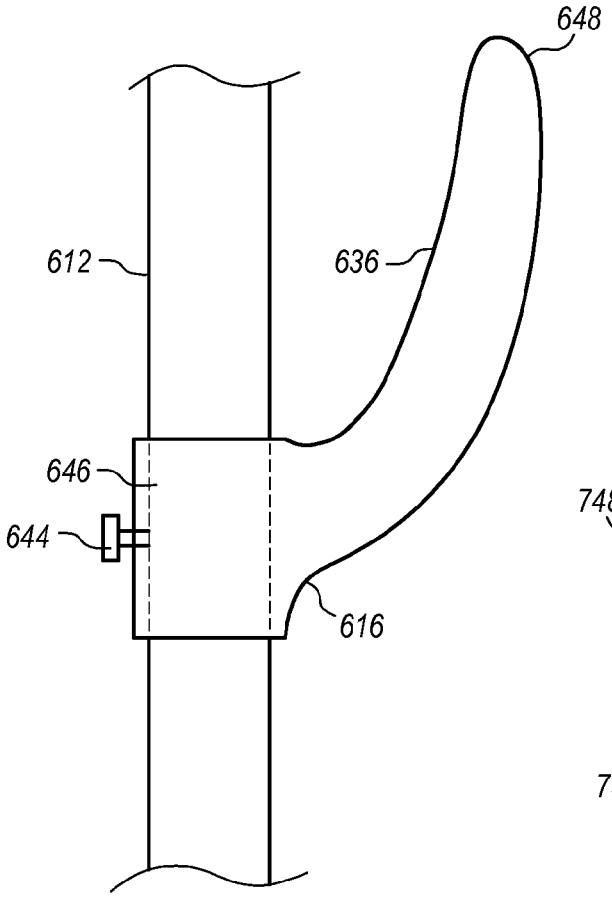
FIG. 6 is a side view of one embodiment of a portion of the shaft and a lower handle assembly of the paddle assembly.

FIG. 6 is a side view of one embodiment of a portion of a shaft assembly 612 and a lower handle assembly 616. In this embodiment, the lower handle assembly 616 is movable relative to the shaft assembly 612. In this embodiment, the lower handle assembly 616 includes a lower handle 636 that is gripped or otherwise held by the user, and a shaft connector 646 that connects the lower handle 636 to the shaft assembly 612. In the embodiment illustrated in FIG. 6, the shaft connector 646 connects the lower handle 636 to the shaft assembly 612 at one location along the shaft assembly 612. The lower handle assembly 616 can be releasably secured to the shaft assembly 612 with a second locking mechanism 644, such as a set screw, or any other suitable type of locking mechanism known to those in the art. The locking mechanism 644 on the lower handle assembly 616 can be released or otherwise loosened, and the position of the lower handle assembly 616 can be adjusted so that the lower handle assembly 616 is moved up and/or down along the shaft assembly 612, and/or rotated about the shaft assembly 612.

In certain embodiments, the lower handle 636 cantilevers or otherwise extends away from the shaft assembly 612 in a substantially upwardly direction, e.g. away from the blade assembly 18 (illustrated in FIG. 1). Alternatively, the lower handle 636 can cantilever in a generally downward direction, e.g. toward the blade assembly 18, or can extend directly away from the shaft assembly 612, neither upwardly or downwardly. In this embodiment, the lower handle 636 includes a second end 648 that is not directly attached to the shaft assembly 612.

Figure 7:
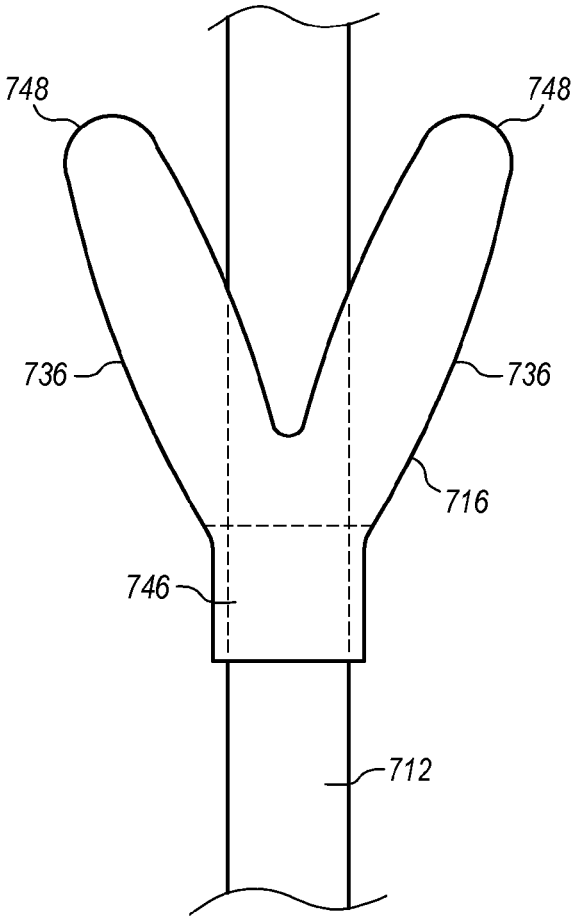
FIG. 7 is a front view of another embodiment of a portion of the shaft and a lower handle assembly of the paddle assembly.

FIG. 7 is a front view of another embodiment of a portion of a shaft assembly 712 and a lower handle assembly 716. In this embodiment, the lower handle assembly 716 is movable relative to the shaft assembly 712. In this embodiment, the lower handle assembly 716 includes a plurality of lower handles 736 that can be alternatingly gripped or otherwise held one-at-a-time by the user, and a shaft connector 746 that connects the lower handle 736 to the shaft assembly 712. In the embodiment illustrated in FIG. 7, two lower handles 736 extend away from the shaft connector 746. In this embodiment, the shaft connector 746 couples the lower handles 736 to the shaft assembly 712 at one location along the shaft assembly 712. The lower handle assembly 716 can be releasably secured to the shaft assembly 712 with a second locking mechanism 644 (such as that illustrated in FIG. 6), or any other suitable type of locking mechanism known to those in the art. The locking mechanism 644 on the lower handle assembly 716 can be released or otherwise loosened, and the position of the lower handle assembly 716 can be adjusted so that the lower handle assembly 716 is moved up and/or down along the shaft assembly 712, and/or rotated about the shaft assembly 712.

In certain embodiments, the lower handles 736 cantilever or otherwise extend away from the shaft assembly 712 in a substantially upwardly direction, e.g. away from the blade assembly 18 (illustrated in FIG. 1). Alternatively, the lower handles 736 can cantilever in a generally downward direction, e.g. toward the blade assembly 18, or can extend directly away from the shaft assembly 712, neither upwardly or downwardly. In this embodiment, the lower handles 736 each include a second end 748 that is not directly attached to the shaft assembly 712.

In another non-exclusive, alternative embodiment, the lower handle assembly 716 can have greater than or fewer than two lower handles 736. For example, the lower handle assembly can have a one or more lower handles 736 that extend upwardly relative to the blade assembly 18, and one or more lower handles that extend downwardly relative to the blade assembly 18.

Figure 8A:
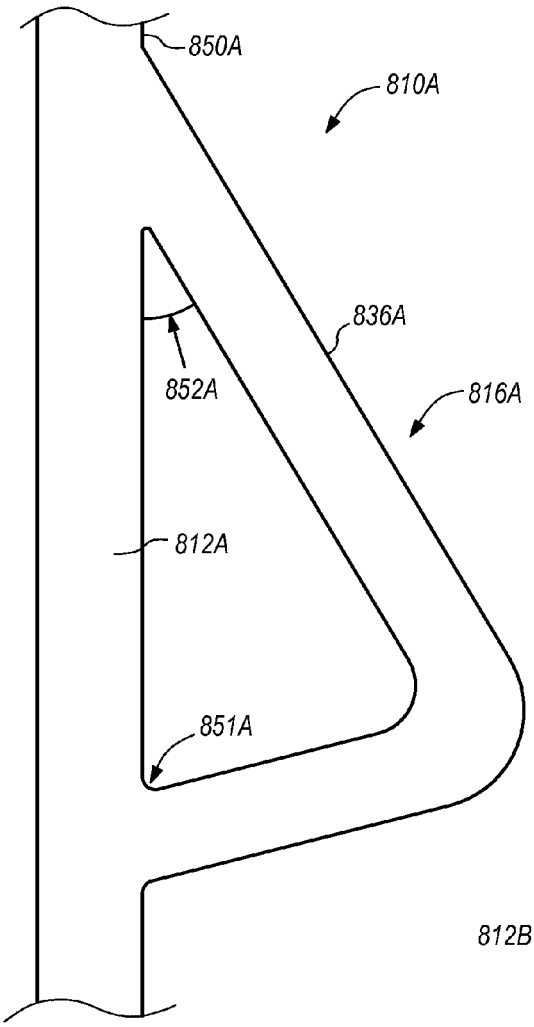
FIG. 8A is a side view of yet another embodiment of a portion of a paddle assembly including a portion of a shaft and a lower handle assembly.

FIG. 8A is a side view of yet another embodiment of a portion of a paddle assembly 810A including a portion of a shaft assembly 812A and a lower handle assembly 816A. In the embodiment illustrated in FIG. 8A, the shaft assembly 812A and the lower handle assembly 816A are formed as a unitary structure. Stated another way, the shaft assembly 812A and the lower handle assembly 816A can be integrally formed so that the lower handle assembly 816A is substantially fixed relative to the shaft assembly 812A. In the embodiment illustrated in FIG. 8A, the lower handle assembly 816A has a second point of connection 850A (also referred to herein as a "first point of connection") with the shaft assembly 812A and a first point of connection 851A (also referred to herein as a "second point of connection") with the shaft assembly 812A. The second point of connection 850A is positioned along the shaft assembly 812A at a point that is further from the blade assembly 18 (illustrated in FIG. 1) than the first point of connection 851A.

In this embodiment, the lower handle assembly 816A includes a lower handle 836A that extends away from the shaft assembly 812A and is gripped by a user during paddling. In this embodiment, the lower handle 836A forms a handle angle 852A (at or near the second point of connection 850A) with the shaft assembly 812A. The handle angle 852A can be varied to suit the design requirements of the paddle assembly 810A and/or the lower handle assembly 816A. In one embodiment, the handle angle 852A can be greater than 0 degrees and less than approximately 80 degrees. In non-exclusive alternative embodiments, the handle angle 852A can be greater than approximately 10 degrees and less than approximately 70 degrees, greater than approximately 15 degrees and less than approximately 60 degrees, greater than approximately 20 degrees and less than approximately 50 degrees, or greater than approximately 25 degrees and less than approximately 40 degrees. In still another alternative embodiment, the handle angle 852A can be approximately 30 to approximately 35 degrees. Still alternatively, the handle angle 852A can be any other suitable angle.

Figure 8B:
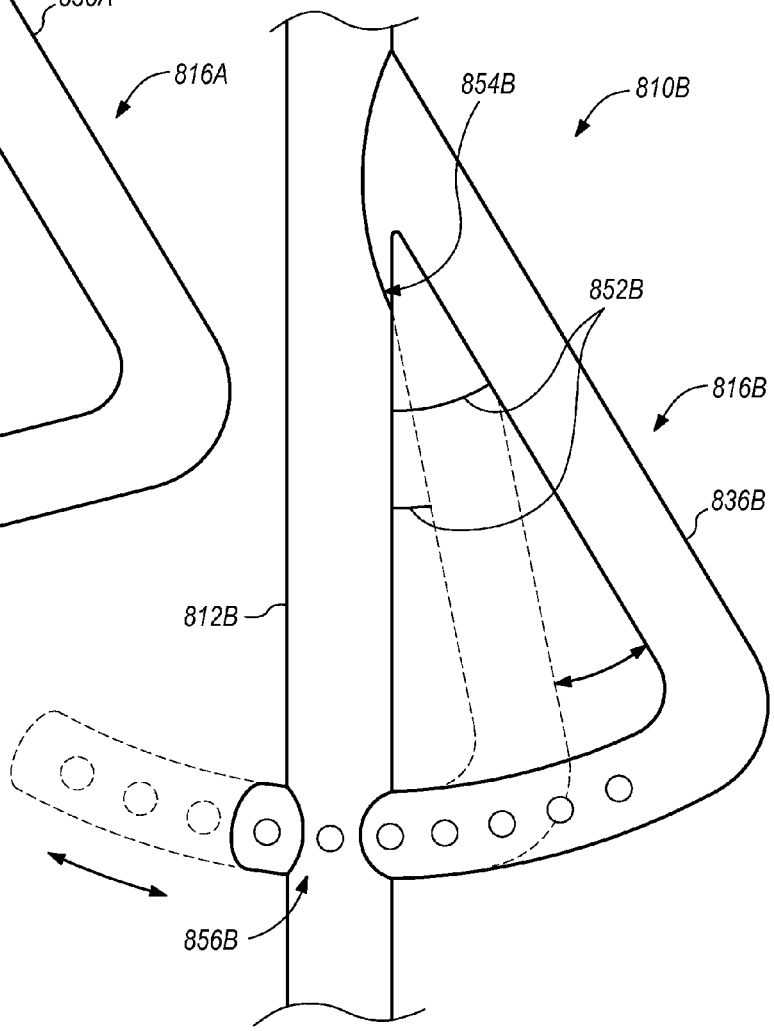
FIG. 8B is a side view of still another embodiment of a portion of a paddle assembly including a portion of a shaft and a lower handle assembly.

FIG. 8B is a side view of still another embodiment of a portion of a paddle assembly 810B including a portion of a shaft assembly 812B and a lower handle assembly 816B shown in a first position (in solid lines) and a second position (in phantom). It is recognized that the two positions shown in FIG. 8B are for illustrative purposes only, and are not intended to be limiting in any manner. In various embodiments, greater than two positions, and up to an infinite number of positions, are achievable.

In this embodiment, the lower handle assembly 816B is pivotally connected to the shaft assembly 812B, and is pivotally movable relative to the shaft assembly 812B. Stated another way, the second handle assembly 816B forms an adjustable handle angle 852B relative to the shaft assembly 812B. The lower handle assembly 816B includes a handle pivot 854B that can allow the lower handle assembly 816B to pivot relative to the shaft assembly 812B in a manner that is known to those skilled in the art.

In the embodiment illustrated in FIG. 8B, the lower handle assembly 816B also includes a locking mechanism 856B that fixedly secures the lower handle assembly 816B in one of a plurality of different positions relative to the shaft assembly 812B. The type of locking mechanism 856B can be varied depending upon the design requirements of the paddle assembly 810B, the shaft assembly 812B and/or the lower handle assembly 816B, as understood by those skilled in the art. In one embodiment, the locking mechanism 856B can include a spring-loaded, push button and/or ball-bearing mechanism that selectively locks the lower handle assembly 816B in one of the plurality of positions.

Figure 8C:
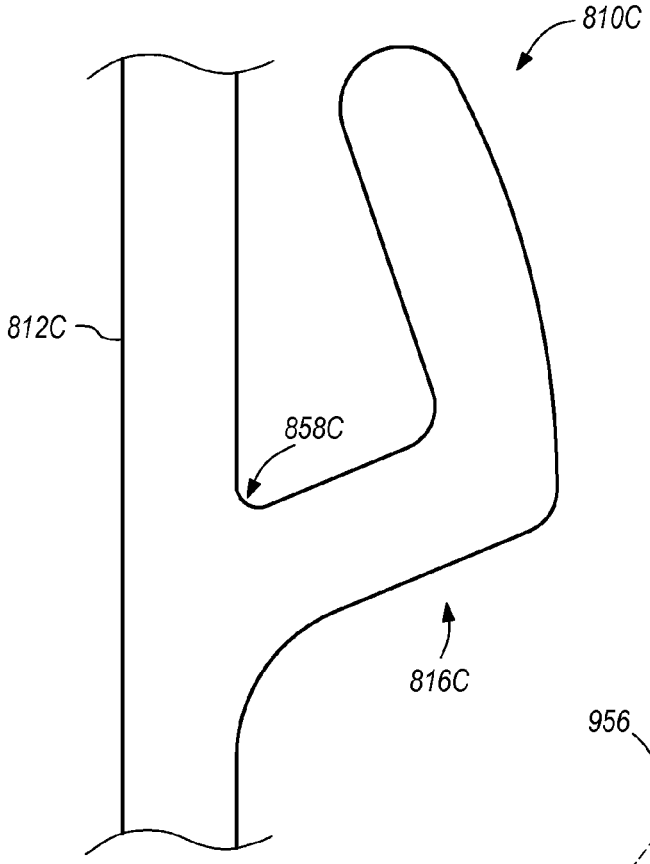
FIG. 8C is a side view of another embodiment of a portion of a paddle assembly including a portion of a shaft and a lower handle assembly.

FIG. 8C is a side view of another embodiment of a portion of a paddle assembly 810C including a portion of a shaft assembly 812C and a lower handle assembly 816C. In the embodiment illustrated in FIG. 8C, the shaft assembly 812C and the lower handle assembly 816C are formed as a unitary structure. Stated another way, the shaft assembly 812C and the lower handle assembly 816C can be integrally formed so that the lower handle assembly 816C is substantially fixed relative to the shaft assembly 812C. In the embodiment illustrated in FIG. 8C, the upper handle assembly 816C only includes one point of connection 858C with the shaft assembly 812C.

Figure 9:
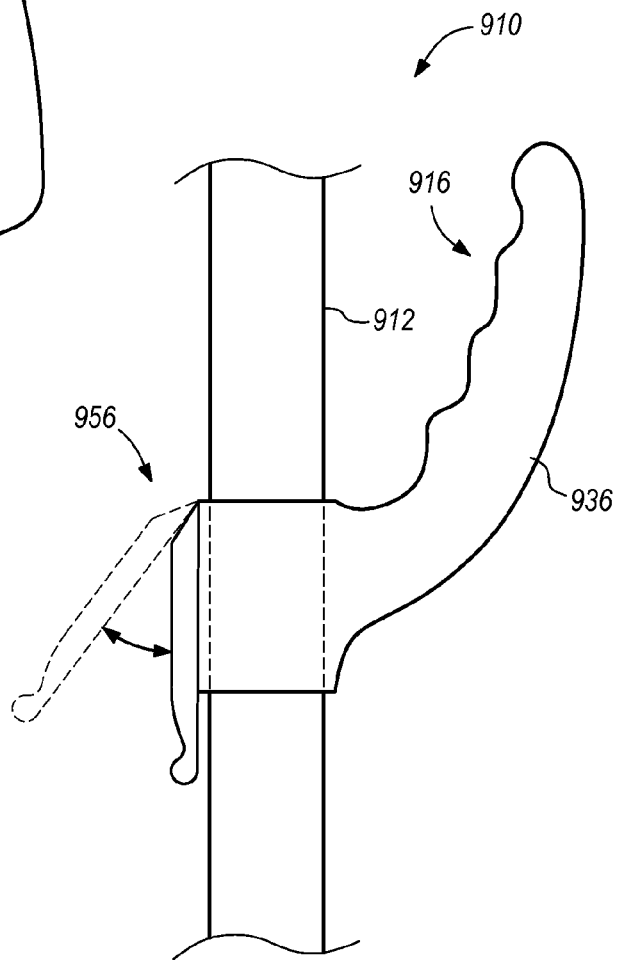
FIG. 9 is a side view of but another embodiment of a portion of a paddle assembly including a portion of a shaft and a lower handle assembly.

FIG. 9 is a side view of but another embodiment of a portion of a paddle assembly 910 including a portion of a shaft assembly 912 and a lower handle assembly 916. In the embodiment illustrated in FIG. 9, the lower handle assembly 916 is releasably securable to the shaft assembly 912 with a locking mechanism 956. In this embodiment, the locking mechanism 956 can be a "quick release" type of mechanism that can alternately lock and unlock, or any other suitable locking mechanism known to those skilled in the art that can releasably secure the lower handle assembly 916 to the shaft assembly 912. The lower handle assembly 916 can be rotated about the shaft assembly 912, or moved along the length 24 (illustrated in FIG. 1) of the shaft assembly 912. Further, in this embodiment, the lower handle assembly 916 includes a lower handle 936 that extends in a generally upwardly direction from the shaft assembly 912, e.g. away from the blade assembly 18 (illustrated in FIG. 1). However, it is recognized that the lower handle 936 can extend away from the shaft assembly 912 in any suitable direction.

Figure 10A:
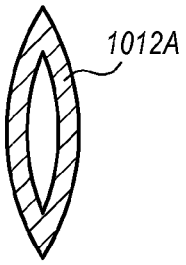
FIG. 10A is a cross-sectional view of one embodiment of the shaft of the paddle assembly taken at line 10-10 in FIG. 1.
Figure 10B:
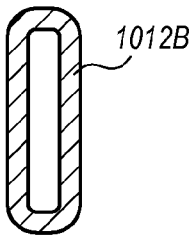
FIGS. 10B-10K are cross-sectional views of various alternative embodiments of the shaft of the paddle assembly taken on line 10-10 in FIG. 1.
Figure 10C:
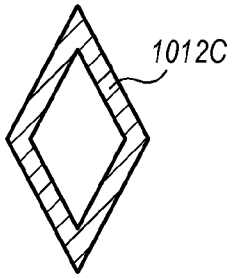
Figure 10D:
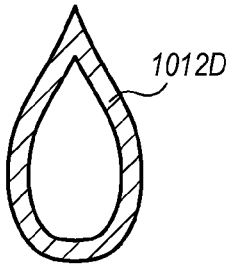
Figure 10E:
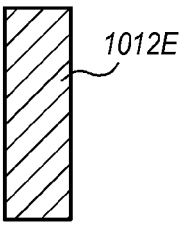
Figure 10F:
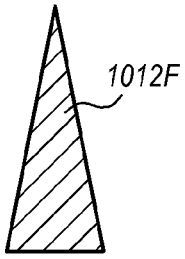
Figure 10G:
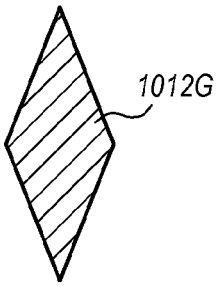
Figure 10H:
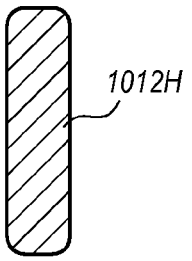
Figure 10I:
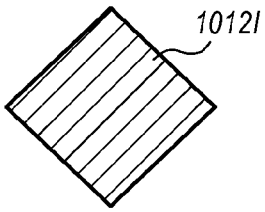
Figure 10J:
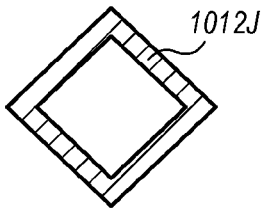
Figure 10K:
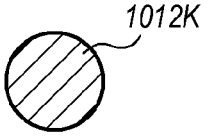

FIG. 10A is a cross-sectional view of one embodiment of the shaft assembly 1012A taken at line 10-10 in FIG. 1. As provided in various embodiments herein, because the user does not hold onto the shaft assembly 1012A directly, but instead holds onto the handle assemblies 14, 16, the cross-sectional configuration of the shaft assembly 1012A can be non-circular. For example, the shaft assembly 1012A can have the cross-sectional shape illustrated in the embodiment in FIG. 10A.

FIGS. 10B-10K are cross-sectional views of alternative embodiments of the shaft assembly 1012B-1012K taken on line 10-10 in FIG. 1. As non-exclusive alternative examples, the shaft assembly 1012B-1012K can have one or more of the cross-sectional shapes illustrated in FIGS. 10B-10K. Still alternatively, the shaft assembly 12 can have a circular or tubular shape, or the shaft assembly 12 can have another suitable cross-sectional shape.

Figure 11A:
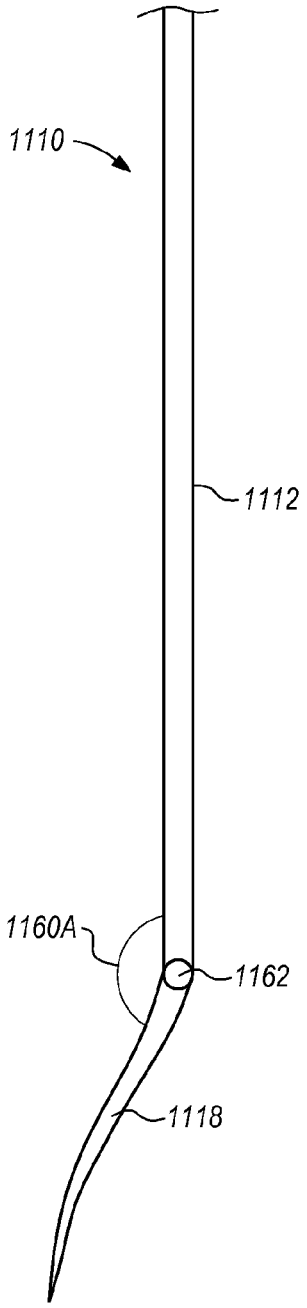
FIG. 11A is a simplified side view of a portion of one embodiment of the paddle assembly including a blade and the shaft, shown in a first position.

FIG. 11A is a simplified side view of a portion of one embodiment of the paddle assembly 1110 including a shaft assembly 1112 and a blade assembly 1118 having a blade assembly 1118 shown in a first position. In the first position, the blade 1158 forms a first blade angle 1160A with the shaft assembly 1112.

Figure 11B:
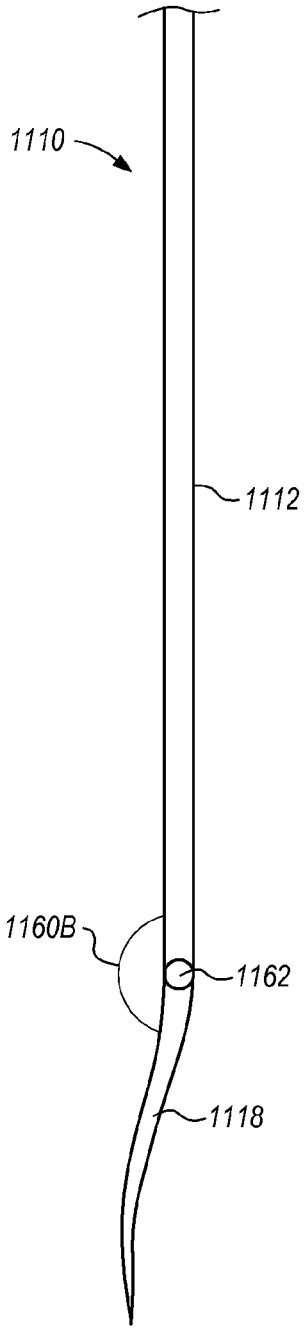
FIG. 11B is a simplified side view of portion of the paddle assembly including the blade and the shaft illustrated in FIG. 11A, shown in a second position.

FIG. 11B is a simplified side view of portion of the paddle assembly 1110 illustrated in FIG. 11A, including the shaft assembly 1112 and the blade assembly 1118 with the blade 1158 shown in a second position. In the second position, the blade 1158 forms a second blade angle 1160B with the shaft assembly 1112 that is somewhat greater than the first blade angle 1160A (illustrated in FIG. 11A).

Figure 11C:
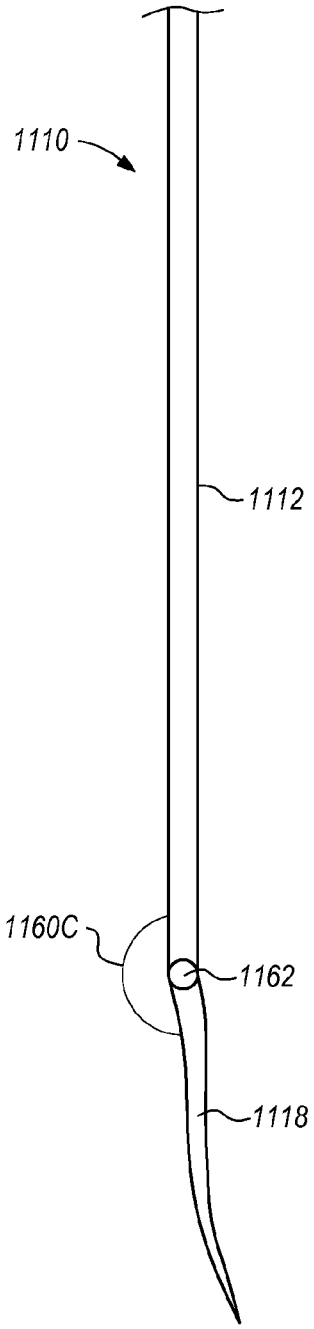
FIG. 11C is a simplified side view of portion of the paddle assembly including the blade and the shaft illustrated in FIG. 11A, shown in a third position.

FIG. 11C is a simplified side view of portion of the paddle assembly 1110 illustrated in FIG. 11A, including the shaft assembly 1112 and the blade assembly 1118 with the blade 1158 shown in a third position. In the third position, the blade 1158 forms a third blade angle 1160C with the shaft assembly 1112 that is somewhat greater than the first blade angle 1160A (illustrated in FIG. 11A) and the second blade angle 1160B (illustrated in FIG. 11B).

In the embodiments illustrated in FIGS. 11A-11C, the paddle assembly 1110 includes a blade angle adjuster 1162 that is used to adjust the blade angles 1160A-1160C per the requirements of the user. The specific type of blade angle adjuster 1162 can vary to suit the design requirements of the paddle assembly 1110. It is understood that the blade angles 1160A-1160C illustrated herein are representative of a wide variety of blade angles that can be achieved with the present invention, and such blade angles illustrated in FIGS. 11A-11C are not intended to limit the scope of blade angles that can be achieved with the paddle assembly 1110.

There are various ways that the blade angle adjuster 1162 can operate. In one embodiment, the blade angle adjuster 1162 can include a first adjuster member 2163F (illustrated in FIGS. 21B-21C, for example) and a second adjuster member 2163S (illustrated in FIGS. 21B-21C, for example) that can be releasably secured to one another to allow rotation and/or adjustability of the blade angle 1160A-1160C, as described in greater detail herein. Other suitable ways of achieving adjustability of the blade angle 1160A-1160C can similarly be utilized as part of the present invention.

Figures 12A, 12B, 12C, 12D, 12E, 12F, 12G:
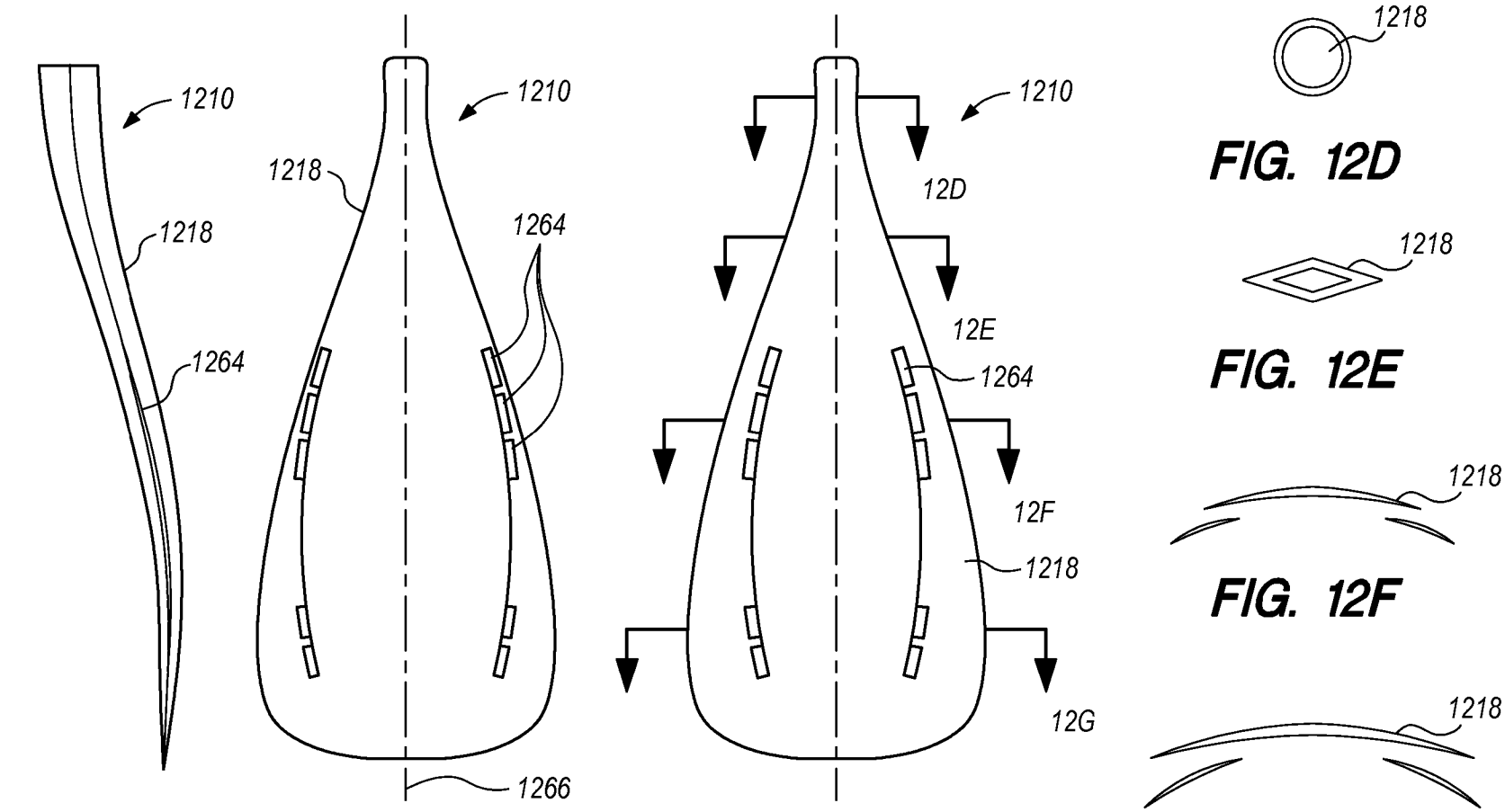
FIG. 12A is a side view of one embodiment of a blade of the paddle assembly.
FIG. 12B is a rear view of the blade illustrated in FIG. 12A.
FIG. 12C is a front view of the blade illustrated in FIG. 12A.
FIG. 12D is a simplified cross-sectional view of the blade illustrated taken on line 12D in FIG. 12C.
FIG. 12E is a simplified cross-sectional view of the blade illustrated taken on line 12E in FIG. 12C.
FIG. 12F is a simplified cross-sectional view of the blade illustrated taken on line 12F in FIG. 12C.
FIG. 12G is a simplified cross-sectional view of the blade illustrated taken on line 12G in FIG. 12C.

FIG. 12A is a side view of one embodiment of a blade assembly 1218 of the paddle assembly 1210. In this embodiment, the blade assembly 1218 includes a blade 1258 having one or more vents 1264 that increase the level of turbulence in the water during paddling. The pattern of vents 1264 can be such that the vents 1264 are symmetrical about a longitudinal axis 1266 of the blade 1258. Alternatively, the vents 1264 can have a random or semi-random positioning on the blade 1258.

FIG. 12B is a rear view of the blade assembly 1218 illustrated in FIG. 12A. The pattern of vents 1264 can be such that the vents 1264 are symmetrical about a longitudinal axis 1266 of the blade 1258. Alternatively, the vents 1264 can have a random or semi-random positioning on the blade 1258.

FIG. 12C is a front view of the blade assembly 1218 illustrated in FIG. 12A.

FIG. 12D is a simplified cross-sectional view of the blade assembly 1218 illustrated taken on line 12D in FIG. 12C.

FIG. 12E is a simplified cross-sectional view of the blade assembly 1218 illustrated taken on line 12E in FIG. 12C.

FIG. 12F is a simplified cross-sectional view of the blade assembly 1218 illustrated taken on line 12F in FIG. 12C.

FIG. 12G is a simplified cross-sectional view of the blade assembly 1218 illustrated taken on line 12G in FIG. 12C.

Figure 13D:
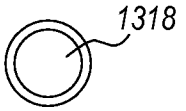
FIG. 13D is a simplified cross-sectional view of the blade illustrated taken on line 13D in FIG. 13C.
Figure 13E:
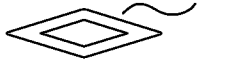
FIG. 13E is a simplified cross-sectional view of the blade illustrated taken on line 13E in FIG. 13C.
Figure 13F:
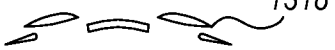
FIG. 13F is a simplified cross-sectional view of the blade illustrated taken on line 13F in FIG. 13C.
Figure 13G:
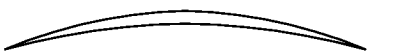
FIG. 13G is a simplified cross-sectional view of the blade illustrated taken on line 13G in FIG. 13C.
Figure 13C:
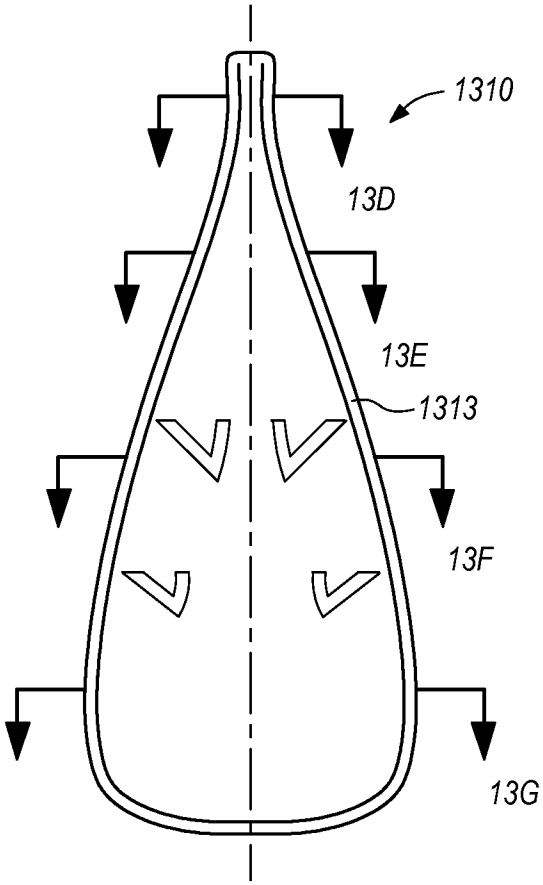
FIG. 13C is a front view of the blade illustrated in FIG. 13A.
Figure 13B:
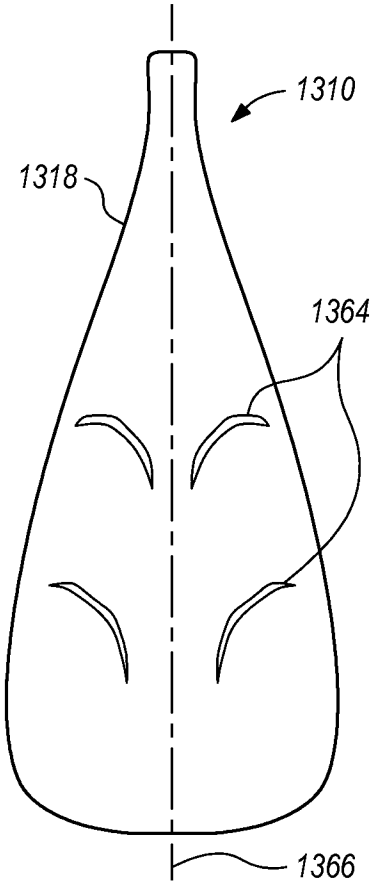
FIG. 13B is a rear view of the blade illustrated in FIG. 13A.
Figure 13A:
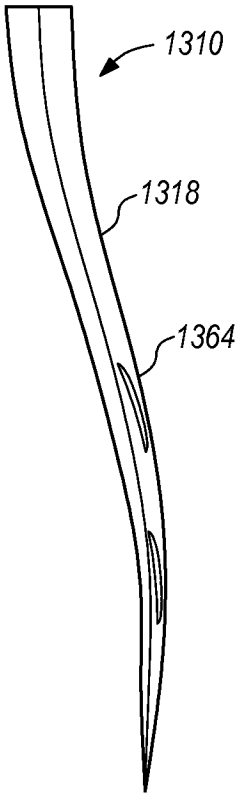
FIG. 13A is a side view of one embodiment of a blade of the paddle assembly.

FIG. 13A is a side view of another embodiment of a blade assembly 1318 of the paddle assembly 1310. In this embodiment, the blade assembly 1318 includes a blade 1358 having one or more vents 1364 that increase the level of turbulence in the water during paddling. The pattern of vents 1364 can be such that the vents 1364 are symmetrical about a longitudinal axis 1366 of the blade 1358. Alternatively, the vents 1364 can have a random or semi-random positioning on the blade 1358.

FIG. 13B is a rear view of the blade assembly 1318 illustrated in FIG. 13A. The pattern of vents 1364 can be such that the vents 1364 are symmetrical about a longitudinal axis 1366 of the blade 1358. Alternatively, the vents 1364 can have a random or semi-random positioning on the blade 1358.

FIG. 13C is a front view of the blade assembly 1318 illustrated in FIG. 13A.

FIG. 13D is a simplified cross-sectional view of the blade assembly 1318 illustrated taken on line 13D in FIG. 13C.

FIG. 13E is a simplified cross-sectional view of the blade assembly 1318 illustrated taken on line 13E in FIG. 13C.

FIG. 13F is a simplified cross-sectional view of the blade assembly 1318 illustrated taken on line 13F in FIG. 13C.

FIG. 13G is a simplified cross-sectional view of the blade assembly 1318 illustrated taken on line 13G in FIG. 13C.

Figure 14A:
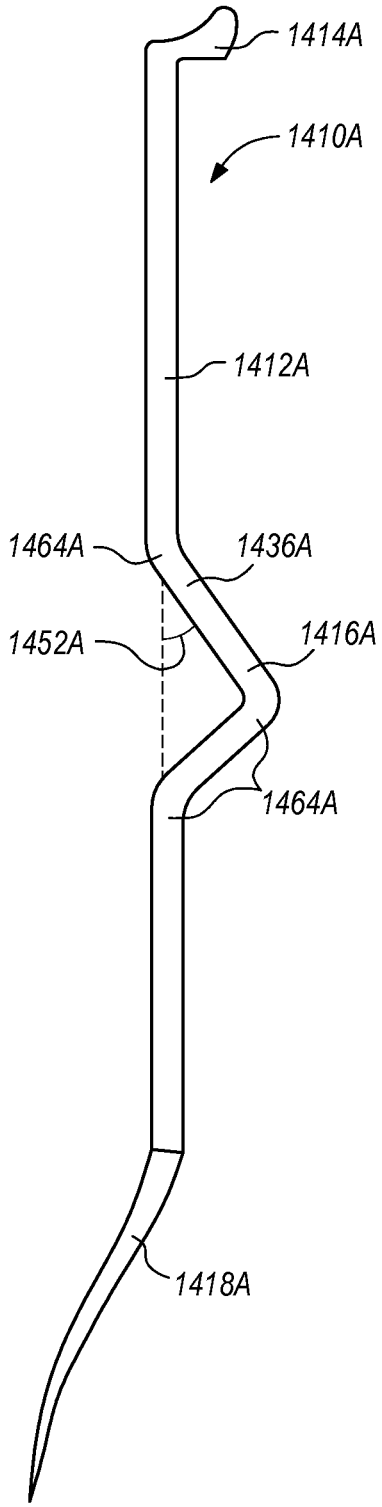
FIG. 14A is a side view of one embodiment of the paddle assembly having features of the present invention.

FIG. 14A is a side view of yet another embodiment of the paddle assembly 1410A. In this embodiment, the paddle assembly 1410A includes a shaft assembly 1412A, an upper handle assembly 1414A, a lower handle assembly 1416A and a blade assembly 1418A. In the embodiment illustrated in FIG. 14A, one or more of the handle assemblies 1414A, 1416A can be formed as a unitary structure with the shaft assembly 1412A. For example, in this embodiment, the lower handle assembly 1416A is formed as a unitary structure with the shaft assembly 1412A. More specifically, the shaft assembly 1412A is not linear, but includes one or more bends, curves and/or angles 1468A (three bends 1468A illustrated in FIG. 14A) that integrally form the lower handle assembly 1416A. Therefore, the advantages of including a lower handle assembly 1416A with a handle 1436A positioned at a handle angle 1452A (that is greater than zero degrees) relative to other portions of the shaft assembly 1412A can be realized without adding a separate lower handle assembly 1416A to the shaft assembly 1412A.

Figure 14B:
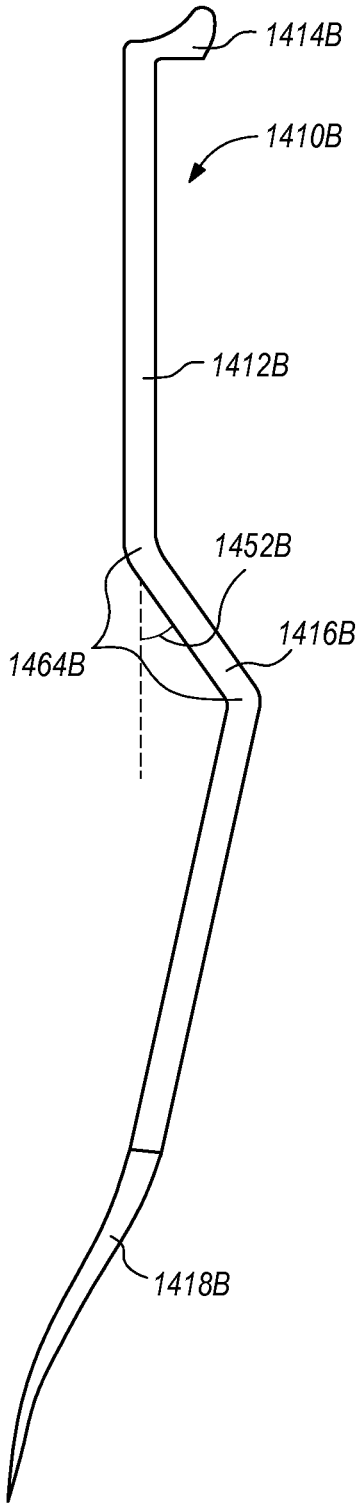
FIG. 14B is a side view of another embodiment of the paddle assembly having features of the present invention.

FIG. 14B is a side view of still another embodiment of the paddle assembly 1410B. In this embodiment, the paddle assembly 1410B includes a shaft assembly 1412B, an upper handle assembly 1414B, a lower handle assembly 1416B and a blade assembly 1418B. In the embodiment illustrated in FIG. 14B, one or more of the handle assemblies 1414A, 1416B can be formed as a unitary structure with the shaft assembly 1412B. For example, in this embodiment, the lower handle assembly 1416B is formed as a unitary structure with the shaft assembly 1412B. More specifically, the shaft assembly 1412B is not linear, but includes one or more bends, curves and/or angles 1468B (two bends 1468B illustrated in FIG. 14B) that integrally form the lower handle assembly 1416B. Therefore, the advantages of including a lower handle assembly 1416B with a handle 1436B positioned at a handle angle 1452B (that is greater than zero degrees) relative to other portions of the shaft assembly 1412B can be realized without adding a separate lower handle assembly 1416B to the shaft assembly 1412B.

Figure 15:
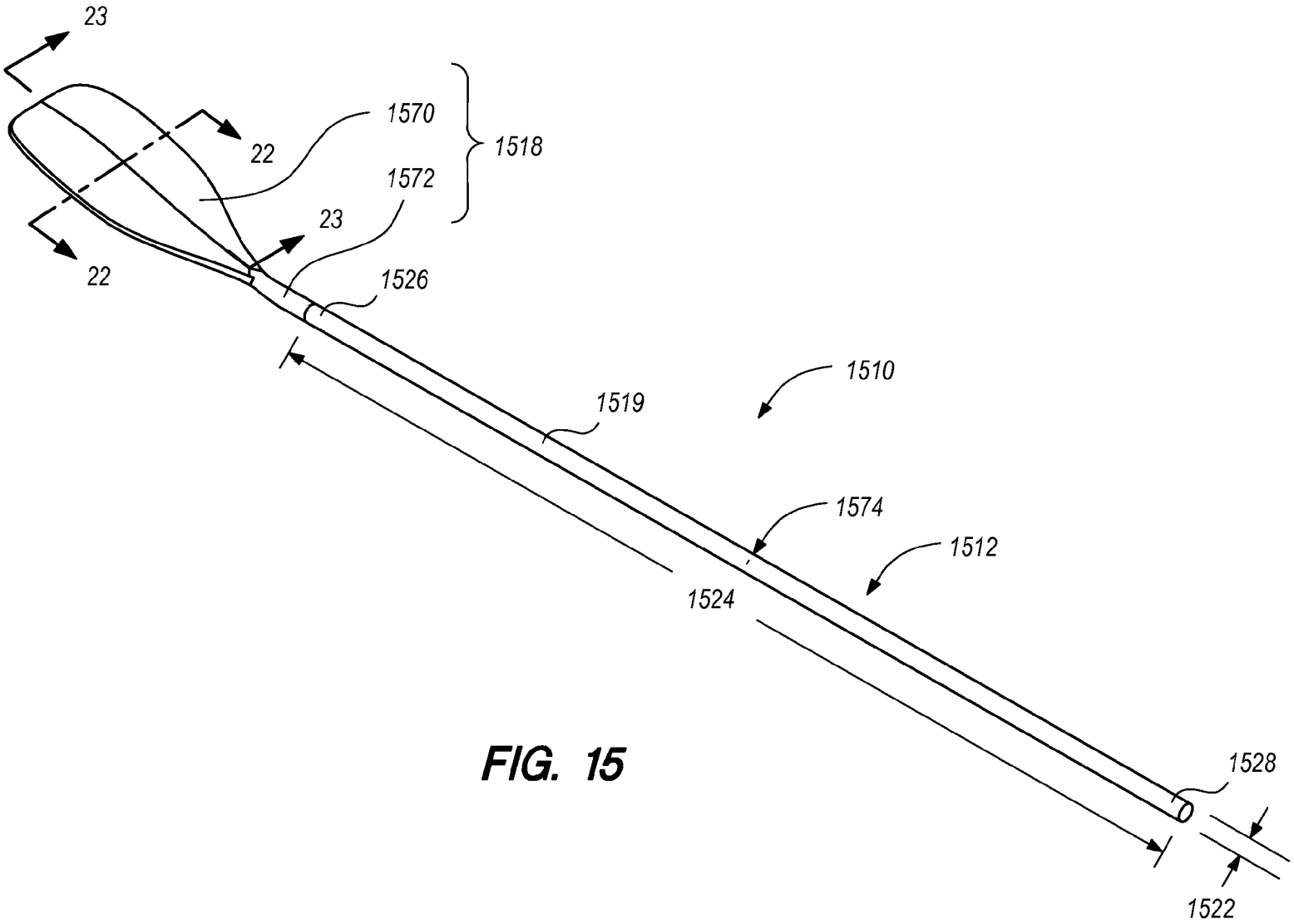
FIG. 15 is a perspective view of one embodiment of a paddle assembly having features of the present invention, including a blade assembly and a shaft assembly.

FIG. 15 is a perspective view of one embodiment of a paddle assembly 1510. In this embodiment, the paddle assembly 1510 includes a shaft assembly 1512 and a blade assembly 1518. The various components of the paddle assembly 1510 described herein can be formed from a variety of different materials, such as composite materials, carbon fiber, fiberglass, various plastics, Kevlar®, various metals, metal alloys, other synthetic fiber materials, and/or any combination thereof. Additionally and/or alternatively, the various components of the paddle assembly 1510 can be formed from other suitable materials.

The shaft assembly 1512 supports and/or is connected or otherwise coupled to the blade assembly 1518. The design of the shaft assembly 1512 can be varied. In various embodiments, the shaft assembly 1512 can include a substantially linear shaft 1519 and a blade coupler assembly 2092 (illustrated in FIG. 20B, for example) that couples or connects the shaft 1519 with the blade assembly 1518, which can be interchangeable or modular in various embodiments.

In certain embodiments, a flexural rigidity (EI) of the shaft assembly 1512 can vary at one or more locations along the shaft length 1524 of the shaft 1519, wherein:

E=modulus of elasticity, and

I=area moment of inertia.

This variance in flexural rigidity can be accomplished one or more different ways, such as by altering the shaft width 1522, altering the composition, e.g., materials, of the shaft 1519 along the shaft length 1524, altering the configuration and/or thickness of a cross-section, e.g., thickness of the walls of the shaft 1519 along the shaft length 1524, varying the mass, weight and/or density of the shaft 1519 along the shaft length 1524, altering the orientation or angle of one or more layers of material along the shaft length 1524, and thus the fibers of the materials within the shaft 1519, altering the types of layers of materials positioned along the shaft length 1524, or by any other suitable method. Additionally and/or alternatively, the configuration or shape of a cross-section of the shaft 1519 can vary along the shaft length 1524.

The shaft 1519 has a first end 1526, a second end 1528 and a midpoint 1574 that is midway between the first end 1526 and the second end 1528. In certain embodiments, the stiffness (or flexibility) of the shaft 1519 can change gradually along the entire shaft length 1524, or for certain portions of the shaft length 1524. In one such embodiment, the stiffness can be greater at the first end 1526 than at the second end 1528. This disparity in stiffness can occur more gradually along the shaft length 1524, or the disparity in stiffness can occur less gradually, suddenly or abruptly along the shaft length 1524. Still alternatively, a certain section of the shaft length 1524 of the shaft 1519 can have a particular degree of stiffness, while another section or sections of the shaft length 1524 of the shaft 1519 can have a different (greater or lesser) degree of stiffness. Further, there can be any number of such sections (i.e. greater than or equal to two sections) of the shaft length 1524 of the shaft 1519 that can have differing degrees of stiffness. In yet another embodiment, the degree of stiffness can be a continuum such that there are an infinite number of different stiffnesses along one or more sections of the shaft length 1524.

The blade assembly 1518 can be removably connected to the shaft assembly 1512 at or near the first end 1526 of the shaft 1519. In certain embodiments, the blade assembly 1518 can be a modular component of the paddle assembly 1510. Stated another way, a first assembly 1518 can be interchangeably replaced with other blade assemblies 1518 having the same or different properties as the first blade assembly 1518. The design of the blade assembly 1518 can be varied to suit the design requirements of the paddle assembly 1510. In certain embodiments, the blade assembly 1518 can include a blade body 1570 and a blade stem 1572. The size, shape and/or geometry of the blade body 1570 can vary. The blade stem 1572 extends away from the blade body 1570. In one embodiment, as described in greater detail herein, the blade stem 1572 selectively receives the shaft assembly 1512 so that the shaft assembly 1512 extends into the blade stem 1572. Alternatively, the blade stem 1572 can selectively extend into the shaft assembly 1512.

Figure 16A:
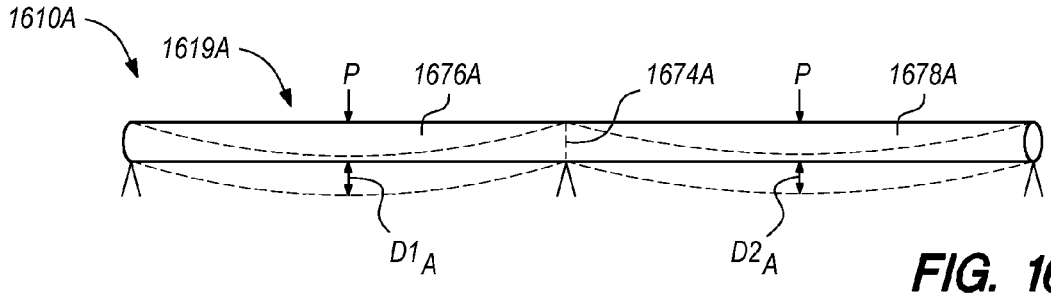
FIG. 16A is a simplified side view of one embodiment of a shaft of the paddle assembly having a first stiffness profile.

FIG. 16A is a simplified side view of one embodiment of a portion of the paddle assembly 1610A including a shaft 1619A having a first stiffness profile. In FIG. 16A, the shaft 1619A includes a shaft midpoint 1674A, a shaft first half 1676A and a shaft second half 1678A. In the embodiment illustrated in FIG. 2A, the shaft first half 1676A has a first flexural rigidity (EI) that is substantially the same as a second flexural rigidity (EI) of the shaft second half 1678A. In this embodiment, an applied load P on the shaft first half 1676A causes a first deflection $D1_A$. Somewhat similarly, the same applied load P on the shaft second half 1678A causes a second deflection $D2_A$ that is substantially similar or identical to the first deflection $D1_A$. In this embodiment, the flexural rigidity (and thus, the flexibility) of each the shaft halves 1676A, 1678A is substantially identical to one another. Further, in one embodiment, an average flexural rigidity of each the shaft halves 1676A, 1678A is substantially identical to one another.

Figure 16B:
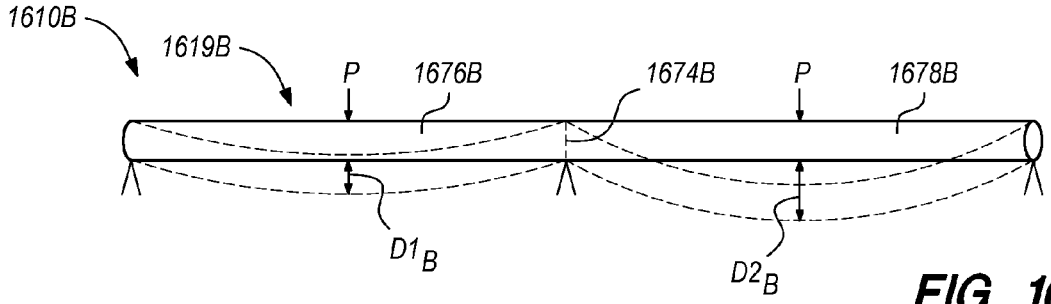
FIG. 16B is a simplified side view of one embodiment of a portion of the paddle assembly including a shaft having a second stiffness profile.

FIG. 16B is a simplified side view of one embodiment of a portion of the paddle assembly 1610B including a shaft 1619B having a second stiffness profile. In FIG. 16B, the shaft 1619B includes a shaft first half 1676B and a shaft second half 1678B. In the embodiment illustrated in FIG. 16B, the shaft first half 1676B has a first flexural rigidity that is defined by the amount of first deflection $D1_B$ caused by the applied load P on the shaft first half 1676B. The shaft second half 1678B has a second flexural rigidity that is defined by the amount of second deflection $D2_B$ caused by the same applied load P on the shaft second half 1678B. In this embodiment, the second deflection $D2_B$ is somewhat greater than the first deflection $D1_B$. Thus, in this embodiment, the shaft first half 1676B has a somewhat greater first flexural rigidity than a second flexural rigidity of the shaft second half 1678B. Stated another way, the shaft second half 1678B is somewhat more flexible than the shaft first half 1676B. The disparity in stiffness (and flexibility) between the shaft halves 1676B, 1678B can vary significantly depending upon the design requirements of the paddle assembly 1610B, from a very slight disparity to a substantial disparity. Further, in one embodiment, an average first flexural rigidity of the shaft first half 1676B can be greater than an average second flexural rigidity of the shaft second half 1678B. In certain non-exclusive alternative embodiments, the average first flexural rigidity of the shaft first half 1676B can be at least approximately 5%, 10%, 15%, 20%, 25%, 30%, 40%, 50%, 60% or 75% greater than an average second flexural rigidity of the shaft second half 1678B.

Figure 16C:
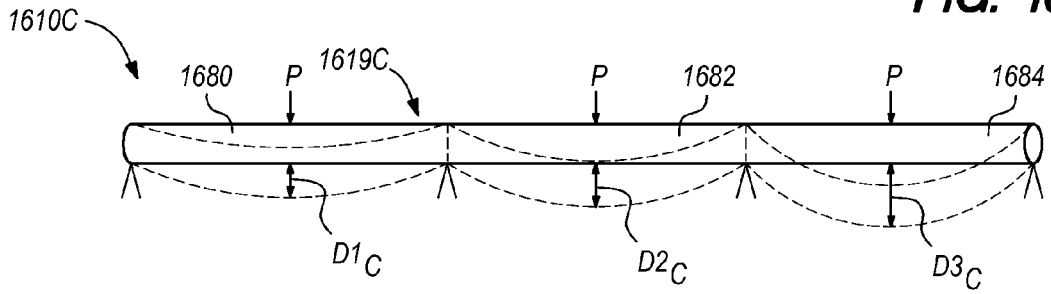
FIG. 16C is a simplified side view of one embodiment of a portion of the paddle assembly including a shaft having a third stiffness profile.

FIG. 16C is a simplified side view of one embodiment of a portion of the paddle assembly 1610C including a shaft 1619C having a third stiffness profile. In FIG. 16C, the shaft 1619C includes a shaft first section 1680, a shaft second section 1682 and a shaft third section 1684. The sections 1680, 1682, 1684 can be substantially the same length as one another. Alternatively, the sections 1680, 1682, 1684 can have different lengths. In the embodiment illustrated in FIG. 16C, the shaft first section 1680 has a first flexural rigidity that is defined by the amount of first deflection $D1_C$ caused by the applied load P on the shaft first section 1680. The second section 1682 has a second flexural rigidity that is defined by the amount of second deflection $D2_C$ caused by the same applied load P on the shaft second section 1682. The shaft third section 1684 has a third flexural rigidity that is defined by the amount of third deflection $D3_C$ caused by the same applied load P on the shaft third section 1684. In this embodiment, the second deflection $D2_C$ is somewhat greater than the first deflection $D1_C$, and the third deflection $D3_C$ is somewhat greater than the second deflection $D2_C$. Thus, in this embodiment, the shaft first section 1680 has a flexural rigidity that is somewhat greater than the shaft second section 1682, and the shaft second section 1682 has a flexural rigidity that is somewhat greater than the shaft third section 1684. Stated another way, the shaft second section 1682 is somewhat more flexible than the shaft first section 1680, and the shaft third section 1684 is somewhat more flexible than the shaft second section 1682. The disparity in stiffness (and flexibility) between the sections 1680, 1682, 1684 can vary significantly depending upon the design requirements of the paddle assembly 1610C.

Figure 17B:
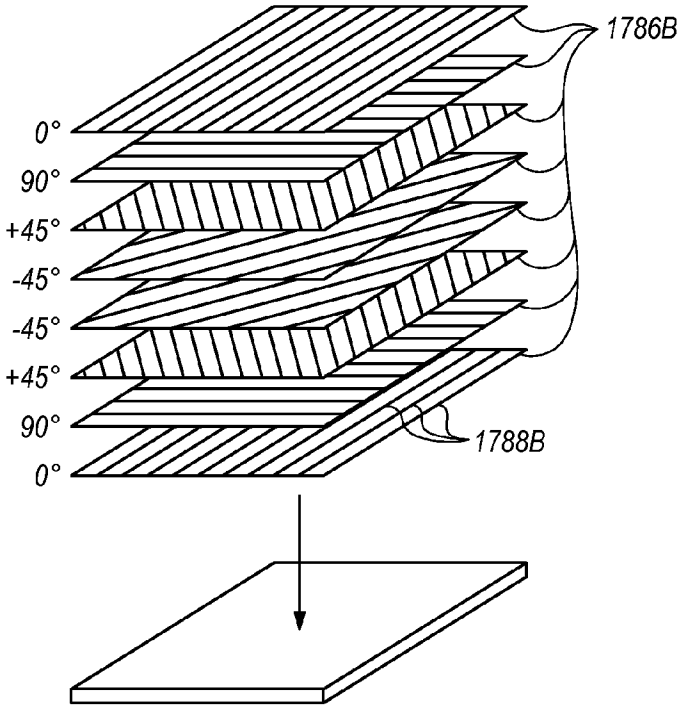
FIG. 17B is a simplified exploded view of another embodiment of a plurality of layers of composite material used to form a portion of the shaft.
Figure 17A:
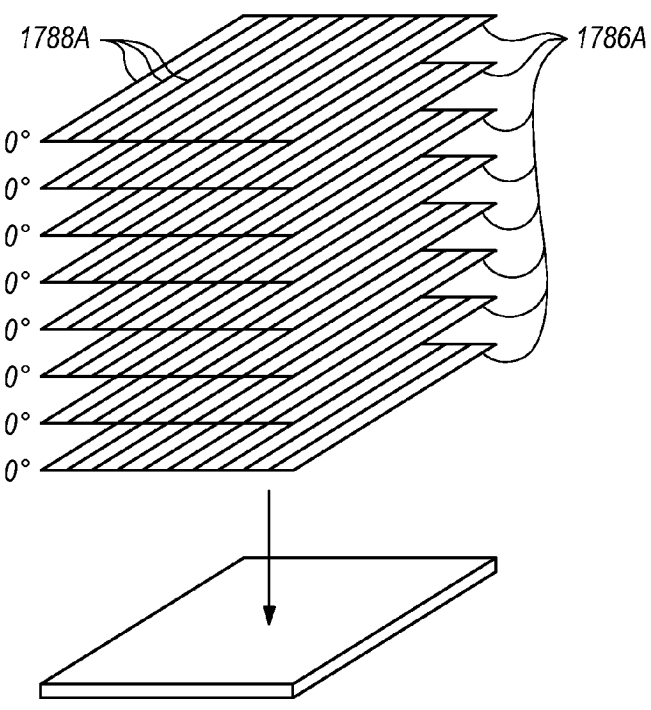
FIG. 17A is a simplified exploded view of one embodiment of a plurality of layers of composite material used to form a portion of the shaft.

FIG. 17A is a simplified exploded view of one embodiment of a portion of a shaft 19 (illustrated in FIG. 1) including a plurality of plies 1786A of material used to form at least a portion of the shaft 19. In this embodiment, the shaft 19 includes a plurality of plies 1786A (also sometimes referred to herein as "layers") that are layered on top of one another. In the embodiment illustrated in FIG. 17A, the plies 1786A are all oriented in unidirectional manner, such that fibers 1788A from each ply 1786A run substantially parallel with the fibers 1788A from every other ply 1786A. With this design, the shaft 19 is designed to have increased (or maximum) stiffness in a direction along the length of the fibers 1788A (such as along the shaft length 24 of the shaft 19, in one embodiment), and a decreased stiffness in directions other than the direction of the length of the fibers 1788A.

FIG. 17B is a simplified exploded view of another embodiment of a portion of a shaft 19 (illustrated in FIG. 1) including a plurality of plies 1786B of material used to form at least a portion of the shaft 19. In this embodiment, the shaft 19 includes a plurality of plies 1786B that are layered on top of one another. In the embodiment illustrated in FIG. 17A, the plies 1786B are not all oriented in the same direction. For example, in this embodiment, the plies 1786B each include fibers 1788B that are positioned to be approximately 45 degrees or 90 degrees different from the fibers 1788B of the plies 1786B directly above and/or below. As used herein, this type of layering is also referred to as "cross-plied" or "quasi-isotropic" layering. It should be recognized that the pattern of plies 1786B illustrated in FIG. 17B is provided for ease of explanation only, and is not intended to be limiting in any manner. In fact, literally thousands or millions of possible layering patterns are contemplated with the present invention. With this design, the stiffness of the shaft 19 in any one or more directions can be varied or tailored to suit the design requirements of the shaft 19 and the paddle assembly 10 (illustrated in FIG. 1). By combining different orientations of the various plies 1786B used along the shaft length 24 (illustrated in FIG. 1) of the shaft 19, the stiffness profile along the entire shaft length 24 of the shaft 19 can be customized and/or varied. Further, it is understood that although eight plies 1786A, 1786B are illustrated in each of FIGS. 17A and 17B, respectively, any number of plies 1786A, 1786B can be incorporated into the shaft 19 of the paddle assemblies 10 disclosed herein. Additionally, the number of plies 1786A, 1786B can change along the shaft length 24.

Additionally, or in the alternative, composite materials used in the shaft 19 may have different fiber stiffnesses, or moduli of elasticity. For example, a very stiff carbon fiber can be referred to as having a "high modulus of elasticity", where as a more standard stiffness carbon fiber is referred to as having a "standard modulus of elasticity". Some types of fiber materials are stiffer than others; for example, carbon fiber is substantially more stiff than fiberglass. Thus, another method for varying the flexibility along the shaft length 24 of the shaft 19 is to vary the modulus of elasticity of the materials used along the shaft length 24 of the shaft 19. In certain embodiments, manufacturing the shaft 19 of the paddle assembly 10 requires an understanding of the stiffness and strength requirements of the shaft 19, and then to tailor the design of the plies 1786A, 1786B to dial in the stiffness and strength along the shaft length 24 of the shaft 19 as necessary to achieve the desired engineering goals.

For example, highly competitive paddlers may require a shaft 19 that has a higher flexural rigidity nearer to the shaft's connection to the blade assembly 18 (illustrated in FIG. 1), and a more lower flexural rigidity further away from the blade assembly 18. This type of flexural rigidity profile can result in a paddle assembly 10 that is very strong and stable while in the water, producing maximum propulsion, while allowing the upper half (the portion of the shaft further away from the blade assembly 18) to "kick" a bit more and produce more energy for the paddler. It can also help the paddlers create a smooth and quick exit of the paddle assembly 10 from the water after each stroke. Less accomplished, weaker and/or recreational paddlers can still benefit from the reduced flex in certain portions of the shaft 19, but also need a little less stiffness of the shaft 19 nearer to the blade assembly 18 to help them propel the paddle assembly 10 more easily through the water. These types of stiffness profiles (among many others) can be accomplished with the present invention.

Figure 17C:
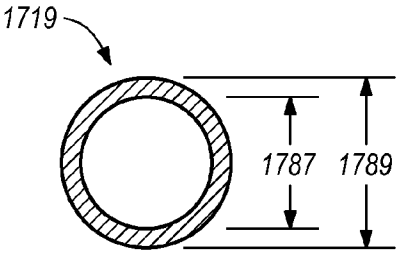
FIG. 17C is a cross-sectional view of one embodiment of the shaft of the paddle assembly taken at line 17C-17C in FIG. 1.

FIG. 17C is a cross-sectional view of one embodiment of the shaft of the paddle assembly taken at line 17C-17C in FIG. 1. In this embodiment, the cross-section of the shaft is substantially tubular. The shaft illustrated in FIG. 17C includes an inner diameter 1787 and an outer diameter 1789. In one embodiment, the inner diameter 1787 of the shaft 1719 remains substantially constant along the shaft length 1524 (illustrated in FIG. 15, for example) of the shaft 1719. In various non-exclusive alternative embodiments, the inner diameter 1787 varies by less than approximately 0.5%, 1%, 2%, 3%, 4%, 5%, 7.5%, 10%, 15% or 20% along the shaft length 1524 of the shaft 1719. Alternatively, the inner diameter 1787 can vary by greater than approximately 20% along the shaft length 1524 of the shaft 1719. In certain embodiments, this type of consistency in the inner diameter 1787 is achieved despite the relatively significant variance in the flexural rigidity along the shaft length 1524 of the shaft 1719 using one or more of the teachings provided herein.

Additionally, or alternatively, the outer diameter 1789 of the shaft 1719 remains substantially constant along the shaft length 1524 of the shaft 1719. In various non-exclusive alternative embodiments, the outer diameter 1789 varies by less than approximately 0.5%, 1%, 2%, 3%, 4%, 5%, 7.5%, 10%, 15% or 20% along the shaft length 1524 of the shaft 1719. Alternatively, the outer diameter 1789 can vary by greater than approximately 20% along the shaft length 1524 of the shaft 1719. In certain embodiments, this type of consistency in the outer diameter 1789 is achieved despite the significant variance in the flexural rigidity along the shaft length 1524 of the shaft 1719 using one or more of the teachings provided herein.

Figure 18:
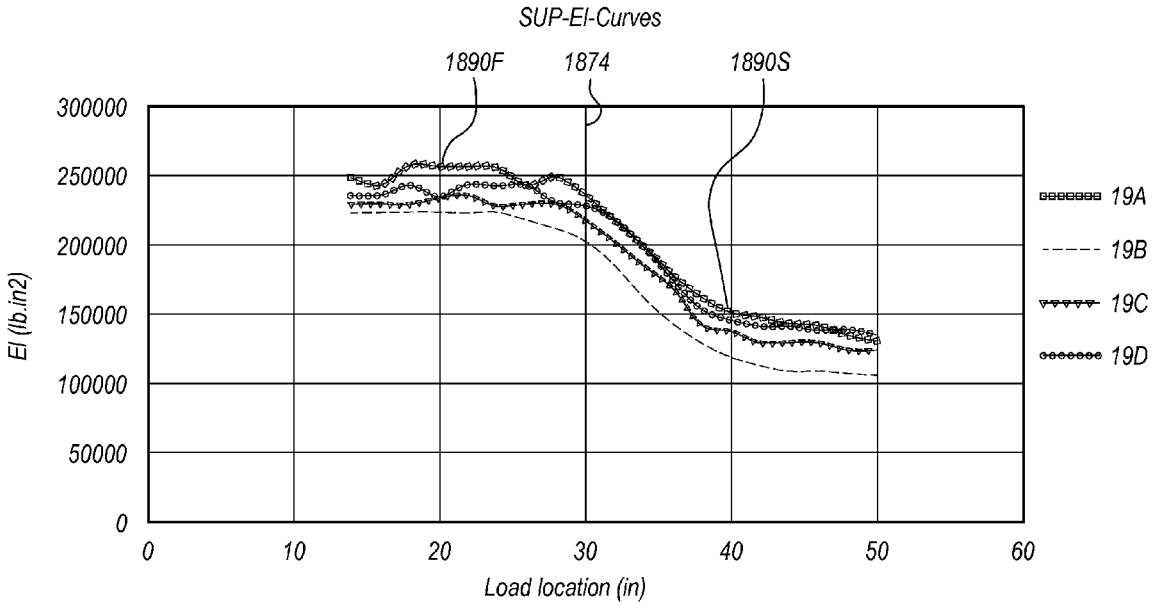
FIG. 18 is a graph showing four different curves of EI as a function of location along the shaft of four different embodiments of the paddle assembly indicated as 19A, 19B, 19C and 19D.

FIG. 18 is a graph showing four different curves of flexural rigidity as a function of location along the shaft 1519 (illustrated in FIG. 15, for example) of four different embodiments of the paddle assembly indicated as 19A, 19B, 19C and 19D. As illustrated in each of the curves in FIG. 18, the flexural rigidity varies along a shaft length 1524 of the shaft 1519 to various extents. It is understood that the curves illustrated in FIG. 18 are just four examples of flex profiles for four different shafts of embodiments of the paddle assembly 1510 shown and described herein, and are not intended to limit, restrict or otherwise detract from the different types of flex profiles of the paddle assembly 1510 in any manner. In certain embodiments, the flexural rigidity can remain relatively consistent for a certain length of the shaft 1519, and then the flexural rigidity can transition to a greater or lesser flexural rigidity. It is recognized that an infinite number of flex profiles for the shaft 1519 can be incorporated into the shaft 1519 of the paddle assembly 1510 using the teachings provided herein.

FIG. 19A is a table showing deflection and EI (flexural rigidity) as a function of location and load on one embodiment of the shaft 1519 (illustrated in FIG. 15, for example), corresponding to curve 19A in FIG. 18. As illustrated in FIG.

18, any two locations along any particular curve can correspond to any two locations on a shaft 1519 having features of the paddle assemblies shown and described herein. In one non-exclusive yet representative example, curve 19A in FIG. 18 identifies a first location 1890F along the shaft length 1524 (illustrated in FIG. 15, for example) of the shaft 1519 and a second location 1890S along the shaft length 1524 of the shaft 1519. In this example, as shown in FIG. 19A, the first location 1890F (at 20 inches along the shaft length 1524) has a first flexural rigidity (EI) of approximately 256,449 lb-in$^2$. The second location 1890S (at 40 inches along the shaft length 1524) has a second flexural rigidity (EI) of approximately 151,770 lb-in$^2$. In this non-exclusive example, a ratio of the flexural rigidity at the first location 1890F to the flexural rigidity at the second location 1890S is approximately 1.69. Further, in this example, the first location 1890F is on an opposite side of the shaft midpoint 1674A (illustrated in FIG. 16A, for example) from the second location 1890S. In FIG. 18, the shaft midpoint 1874 of each of the shafts 19A-19D is at the 30 inch position on the graph.

In various alternative, non-exclusive embodiments of the shaft 1519, the ratio of the flexural rigidity at the first location 1890F to the flexural rigidity at the second location 1890S is greater than approximately 1.05, 1.10, 1.15, 1.20, 1.30, 1.40, 1.50, 1.60, 1.70, 1.80, 1.90 or 2.00.

In further alternative, non-exclusive embodiments, the first location 1890F and the second location 1890S can be at any two points along the shaft length 1524. In certain embodiments, the first location 1890F and the second location 1890S can be on opposite sides of the shaft midpoint 1874 from one another. In some embodiments, the first location 1890F and the second location 1890S can be on opposite sides of the shaft midpoint 1874 from one another, and are substantially equidistant from one another. In still other embodiments, the first location 1890F and the second location 1890S can both be on the same side of the shaft midpoint 1874.

FIG. 19B is a table showing deflection and EI as a function of location and load for another embodiment of the shaft 1519, corresponding to curve 19B in FIG. 18.

FIG. 19C is a table showing deflection and EI as a function of location and load for yet another embodiment of the shaft 1519, corresponding to curve 19C in FIG. 18.

FIG. 19D is a table showing deflection and EI as a function of location and load for still another embodiment of the shaft 1519, corresponding to curve 19D in FIG. 18.

Figure 20A:
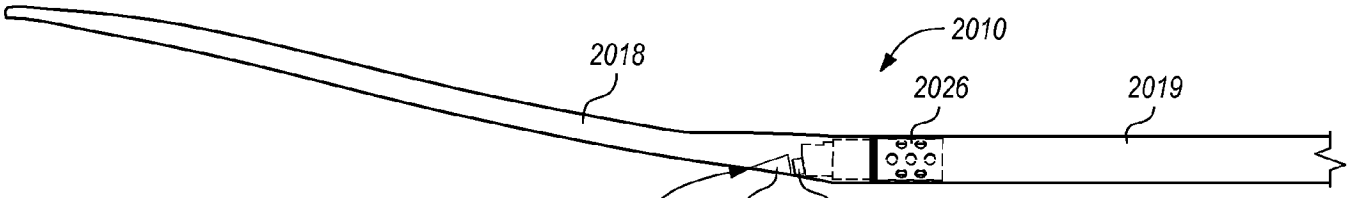
FIG. 20A is a side view of a portion of one embodiment of the paddle assembly with certain internal components visible in phantom.
Figure 20B:
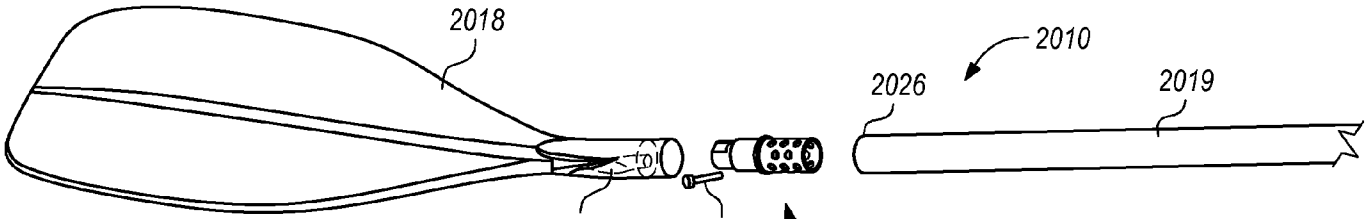
FIG. 20B is an exploded perspective view of a portion of the paddle assembly illustrated in FIG. 20A with certain internal components visible in phantom.
Figure 20C:
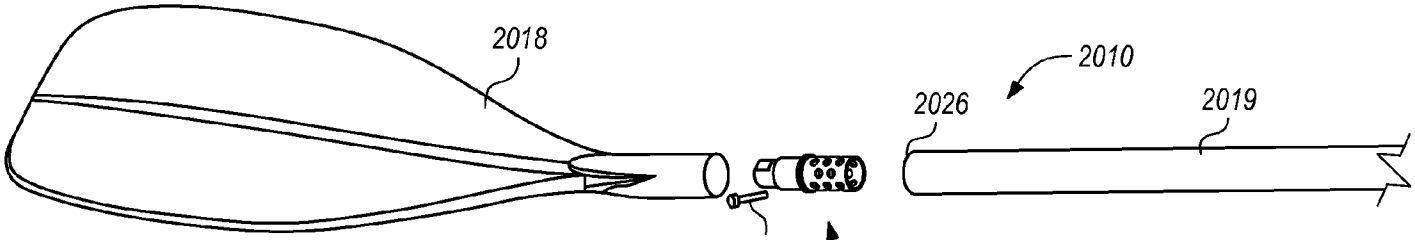
FIG. 20C is an exploded perspective view of a portion of the paddle assembly illustrated in FIG. 20A.

FIG. 20A is a side view of a portion of one embodiment of the paddle assembly 2010 with certain internal components visible in phantom. FIG. 20B is an exploded perspective view of a portion of the paddle assembly 2010 illustrated in FIG. 20A with certain internal components shown in phantom. FIG. 20C is an exploded perspective view of a portion of the paddle assembly 2010 illustrated in FIG. 20A.

In this embodiment, the paddle assembly 2010 includes a blade assembly 2018, a shaft 2019 and a blade coupler assembly 2092. In this embodiment, the blade coupler assembly 2092 is inserted into or otherwise secured to a first end 2026 of the shaft 2019. The blade assembly 2018 includes a fastener recess 2093 that receives one or more blade fasteners 2094 that secure the blade assembly 2018 to the blade coupler assembly 2092 of the shaft 2019. In one embodiment, the blade coupler assembly 2092 and the shaft 2019 are integrally formed as a unitary structure so that the blade coupler assembly 2092 is inhibited from being separated from the shaft 2019. In another embodiment, the blade coupler assembly 2092 can be secured to the shaft 2019 with a fastener (not shown), an adhesive, threads, or by another suitable method that decreases the likelihood of separation of the blade coupler assembly 2092 from the shaft 2019.

In one embodiment, the blade fastener 2094 extends into and/or through the fastener recess 2093 and into the blade coupler assembly 2092. The blade fastener 2094 can be threadedly secured to the blade coupler assembly 2092. Further, the blade fastener 2094 can be removable to allow the blade assembly 2018 to be removed and/or exchanged with another blade assembly 2018 or portion thereof. In one embodiment, the blade fastener 2094 can extend into the blade coupler assembly 2092 at a slight angle, which can vary to suit the design requirements of the paddle assembly 2010. In one embodiment, a removable fastener plug 2095 can be positioned to cover the fastener recess 2093 and the blade fastener 2094 to inhibit water or other unwanted material from entering the fastener recess 2093 and/or to improve water flow over the area of the blade coupler assembly 2092. When in place, the fastener plug 2095 can be substantially flush with the rest of the blade assembly 2018.

In an alternative embodiment, the blade coupler assembly 2092 can be secured to the blade assembly 2018. In this embodiment, the blade fastener 2094 can extend through a portion of the shaft 2019 and into the blade coupler assembly 2092 to securely couple the shaft 2019 to the blade assembly 2018.

Figure 21A:
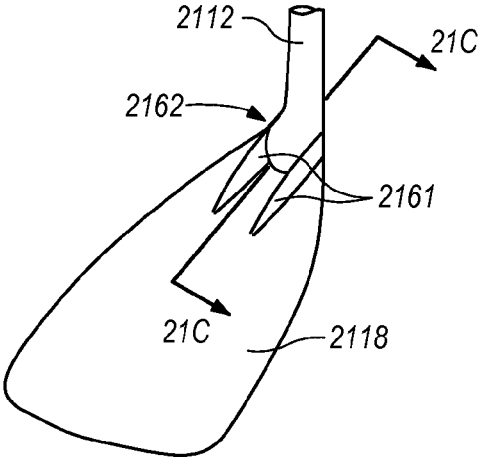
FIG. 21A is a top perspective view of a portion of one embodiment of a paddle assembly, including a blade assembly and a portion of a shaft assembly.

FIG. 21A is a top perspective view of a portion of one embodiment of a paddle assembly 2110, including a detachable blade assembly 2118 and a portion of a shaft assembly 2112. Further, the blade assembly 2118 and the shaft assembly 2112 combine to include a blade angle adjuster 2162. In this embodiment, the blade assembly 2118 is removably and adjustably secured to the shaft assembly 2112. Further, in this embodiment, the blade angle 2160 (illustrated in FIGS. 21D-1 through 21D-3) can be adjusted by removing and remounting the blade assembly 2118 to the shaft assembly 2112 at the desired blade angle, as described in greater detail below. In one embodiment, the blade assembly 2118 can include one or more stabilizers 2161 that are positioned adjacent to the shaft assembly 2112 once the blade assembly 2118 is secured to the shaft assembly 2112. The stabilizers 2161 inhibit rotational movement of the shaft assembly 2112 relative to the blade assembly 2118.

Figure 21B:
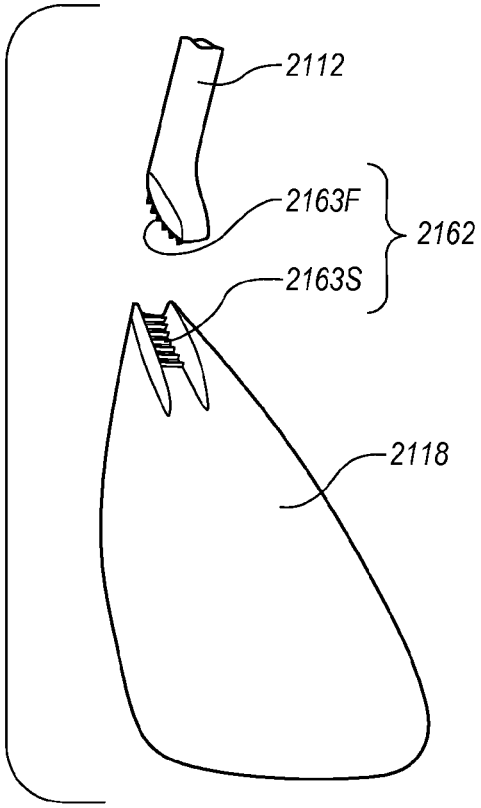
FIG. 21B is a partially exploded view of the portion of the paddle assembly illustrated in FIG. 21A.

FIG. 21B is a partially exploded view of the portion of the paddle assembly 2110 illustrated in FIG. 21A. The blade angle adjuster 2162 includes a first adjuster member 2163F and a second adjuster member 2163S. In this embodiment, the shaft assembly 2112 includes the first adjuster member 2163F, and the blade assembly includes the second adjuster member 2163S. It is recognized, however, that the first adjuster member 2163F can be part of the blade assembly 2118, and the second adjuster member 2163S could be part of the shaft assembly 2112. In one embodiment, the first adjuster member 2163F can interlock with the second adjuster member 2163 using complementary configurations such as ridges or other suitable complementary features, as illustrated in FIG. 21B.

Figure 21C:
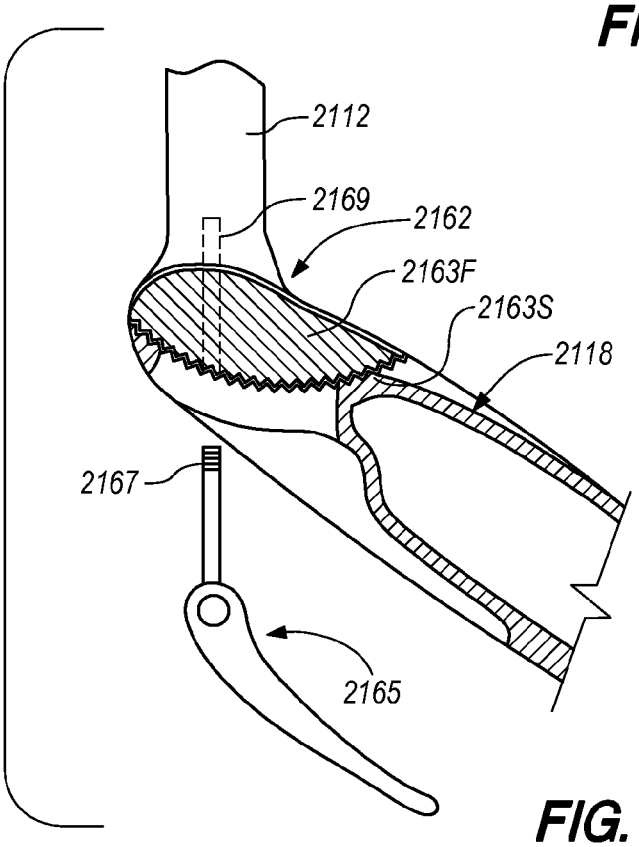
FIG. 21C is a partially exploded cross-sectional view of the portion of the paddle assembly taken on line 21C-21C in FIG. 21A, including a portion of a blade assembly and a portion of a shaft assembly.

FIG. 21C is a partially exploded cross-sectional view of the portion of the paddle assembly 2110 taken on line 21C-21C in FIG. 21A, including a portion of the blade assembly 2118 and a portion of the shaft assembly 2112. In the embodiment illustrated in FIG. 21C, the blade angle adjuster 2162 includes a blade attacher 2165 that releasably attaches the blade assembly 2118 to the shaft assembly 2112. More specifically, in one embodiment, the blade attacher 2165 releasably secures the first adjuster member 2163F and the second adjuster member 2163S together. In one embodiment, the blade attacher 2165 can include a threaded pin 2167 that extends into a pin receiver 2169 of the first adjuster member 2163F. Alternatively, another suitable type of blade attacher 2165 can be used. In one embodiment, the blade attacher 2165 can be a quick release-type of mechanism to allow the user to quickly adjust the blade angle 2160 (illustrated in FIGS. 21D-1 through 21D-3, for example).

Figures 1, 21D:
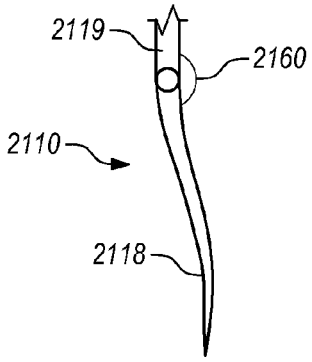
Figures 2, 21D:
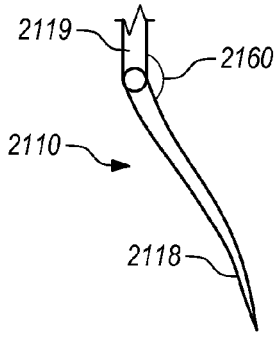
Figures 3, 21D:
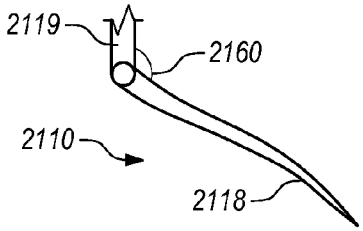

FIGS. 21D-1 through 21D-3 illustrate simplified embodiments of a portion of the paddle assembly 2110 illustrated in FIGS. 21A-21C, including a shaft 2119 and a blade assembly 2118 shown in three different positions relative to the shaft 2119. In this embodiment, the blade assembly 2118 forms a blade angle 2160 relative to the shaft 2119. In various embodiments, the blade angle 2160 can be adjusted by any of the teachings provided herein. In certain embodiments, the blade angle 2160 can be adjusted without the need for removing and/or replacing the blade assembly 2118. In various non-exclusive embodiments, one blade assembly 2118 can alternately form blade angles 2160 with one shaft 2119 ranging between 120-180 degrees. In one embodiment, the blade assembly 2118 can alternately form blade angles 2160 with the shaft 2119 ranging between 155-175 degrees. In still another embodiment, the blade assembly 2118 can alternately form blade angles 2160 with the shaft 2119 ranging between 165-172 degrees. Alternatively, other suitable ranges of blade angles 2160 can be achieved using one blade assembly 2118 with one shaft 2119.

Figure 22A:
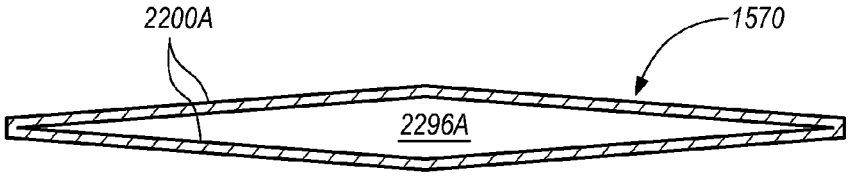
FIG. 22A is a cross-sectional view of one embodiment of a portion of the blade assembly taken on line 22-22 in FIG. 15.

FIG. 22A is a cross-sectional view of one embodiment of the blade body 1570 (illustrated in FIG. 15) of the paddle assembly 1510 (illustrated in FIG. 15) taken on line 22-22 in FIG. 15. In this embodiment, the blade body 1570 is substantially hollow, and includes an enclosure 2296A that is devoid of any solid material. The enclosure 2296A is defined by one or more exterior walls 2200A of the blade body 1570, and can be filled with a fluid, such as air, helium or other gaseous or liquid materials. The size of the enclosure 2296A can vary depending upon the design requirements of the paddle assembly 1510.

Figure 22B:
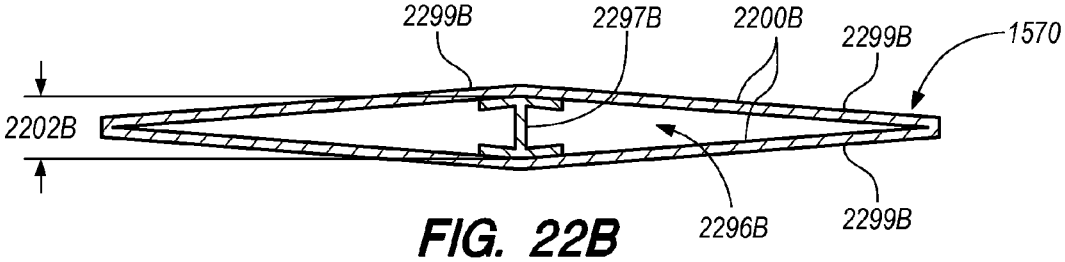
FIG. 22B is a cross-sectional view of another embodiment of a portion of the blade assembly taken on line 22-22 in FIG. 15.

FIG. 22B is a cross-sectional view of another embodiment of the blade body 1570 (illustrated in FIG. 15) of the paddle assembly 1510 (illustrated in FIG. 15) taken on line 22-22 in FIG. 15. In this embodiment, the blade body 1570 is somewhat similar to the blade body 1570 illustrated in FIG. 22A. However, in this embodiment, the blade body 1570 includes a substantially centrally positioned enclosure support 2297B that structurally supports an enclosure 2296B of the blade body 1570. In this embodiment, the enclosure support 2297B is positioned between and connects a top blade surface 2298B and a bottom blade surface 2299B. The enclosure support 2297B inhibits the enclosure 2296B from collapsing and/or inhibits unwanted relative movement between the top blade surface 2298B and the bottom blade surface 2299B. In one embodiment, the enclosure support 2297B is essentially an I-shaped beam (although the specific shape can vary) that can be positioned along an enclosure length 2304B (illustrated in FIG. 23B, for example) of the enclosure 2296B. In one embodiment, a support height 2202B of the enclosure support 2297B is substantially constant along the enclosure length 2304B. In another embodiment, the support height 2202B can vary along the enclosure length 2304B.

In this embodiment, the enclosure 2296B on either side of the enclosure support 2297B can be devoid of any solid material. The enclosure 2296B is defined by one or more exterior walls 2200B of the blade body 1570. The enclosure 2296B on either side of the enclosure support 2297B can be filled with a fluid, such as air, helium or other gaseous or liquid materials. In another embodiment, the enclosure on either side of the enclosure support 2297B can include a lightweight solid material, such as foam or other plastics, as non-exclusive examples. The size and/or volume of the enclosure 2296B can vary depending upon the design requirements of the paddle assembly 1510.

Figure 22C:
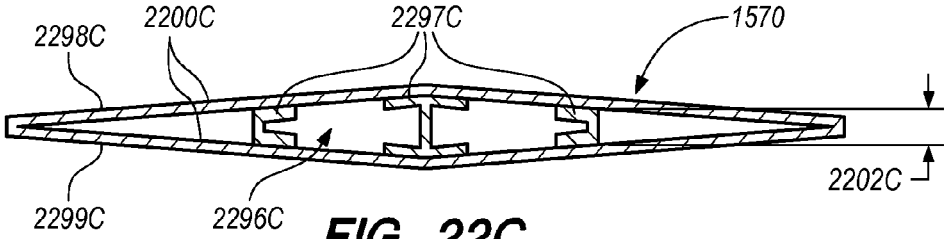
FIG. 22C is a cross-sectional view of yet another embodiment of a portion of the blade assembly taken on line 22-22 in FIG. 15.

FIG. 22C is a cross-sectional view of another embodiment of the blade body 1570 (illustrated in FIG. 15) of the paddle assembly 1510 (illustrated in FIG. 15) taken on line 22-22 in FIG. 15. In this embodiment, the blade body 1570 is somewhat similar to the blade body 1570 illustrated in FIG. 22B. However, in this embodiment, the blade body 1570 includes a plurality of enclosure supports 2297C that structurally support an enclosure 2296C of the blade body 1570. In this embodiment, the enclosure supports 2297C are positioned directly between a top blade surface 2298C and a bottom blade surface 2299C. The enclosure supports 2297C inhibit the enclosure 2296C from collapsing and/or inhibit unwanted relative movement between the top blade surface 2298C and the bottom blade surface 2299C. The positioning and location of the enclosure supports 2297C can vary. In one embodiment, the enclosure supports 2297C can include a centrally I-shaped cross-sectional beam that is substantially similar to the enclosure support 2297B illustrated and described relative to FIG. 22B. Additionally, the enclosure supports 2297C can include one or more lateral supports that are positioned on either or both sides of the centrally I-shaped beam. The specific cross-sectional shape of these enclosure supports 2297C can vary. In one embodiment, one or more of the enclosure supports 2297C can have a substantially C-shaped cross-section, as illustrated in FIG. 22C. In one embodiment, a support height 2202C of each enclosure support 2297C is substantially constant along an enclosure length 2304B (illustrated in FIG. 23B) of the enclosure 2296C. In another embodiment, the support height 2202C can vary along the enclosure length 2304B.

In this embodiment, the enclosure 2296C on either side of the enclosure supports 2297C can be devoid of any solid material. The enclosure 2296C is defined by one or more exterior walls 2200C of the blade body 1570. The enclosure 2296C on either side of the enclosure supports 2297C can be filled with a fluid, such as air, helium or other gaseous or liquid materials. In another embodiment, the enclosures on either side of the enclosure supports 2297C can include a lightweight solid material, such as foam or other plastics, as non-exclusive examples. The size and/or volume of the enclosure 2296C can vary depending upon the design requirements of the paddle assembly 1510.

Figure 23A:
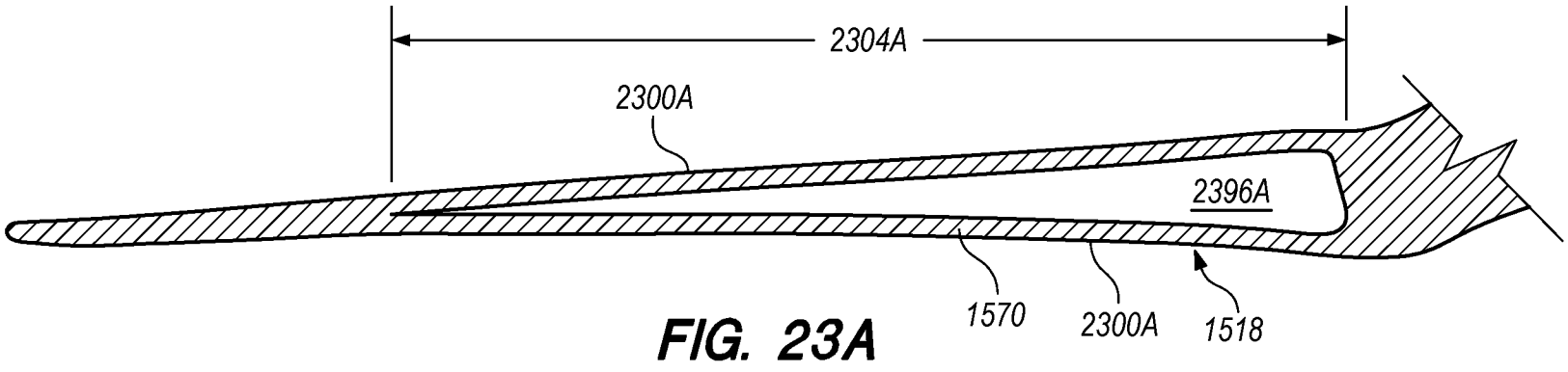
FIG. 23A is a cross-sectional view of one embodiment of a portion of the blade assembly taken on line 23-23 in FIG. 15.

FIG. 23A is a cross-sectional view of one embodiment of a portion of the blade assembly 1518 taken on line 23-23 in FIG. 15, including a portion of a blade body 1570. In this embodiment, the blade body 1570 is substantially hollow, and includes an enclosure 2396A that is devoid of any solid material. The enclosure 2396A is defined by one or more exterior walls 2300A of the blade body 1570, and can be filled with a fluid, such as air, helium or other gaseous or liquid materials. The size of the enclosure 2396A can vary depending upon the design requirements of the paddle assembly 1510 (illustrated in FIG. 15).

Figure 23B:
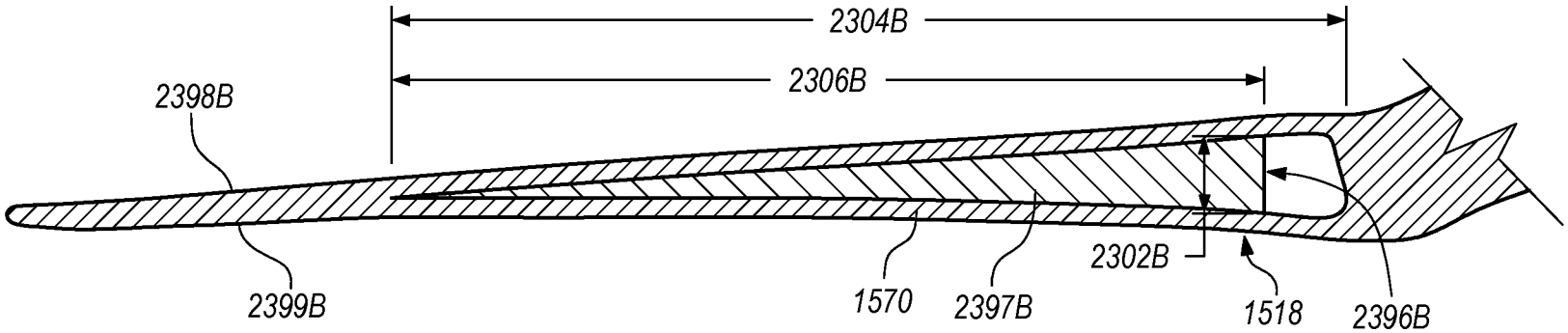
FIG. 23B is a cross-sectional view of another embodiment of a portion of the blade assembly taken on line 23-23 in FIG. 15.

FIG. 23B is a cross-sectional view of another embodiment of a portion of the blade assembly 1518 taken on line 23-23 in FIG. 15. In this embodiment, the blade body 1570 is somewhat similar to the blade body 1570 illustrated in FIG. 23A. However, in this embodiment, the blade body 1570 includes one or more enclosure supports 2397B (only one enclosure support 2397B is illustrated in FIG. 23B) that structurally supports an enclosure 2396B of the blade body 1570. In this embodiment, the enclosure support 2397B is positioned between and connects a top blade surface 2398B and a bottom blade surface 2399B. The enclosure support 2297B inhibits the enclosure 2396B from collapsing and/or inhibits unwanted relative movement between the top blade surface 2398B and the bottom blade surface 2399B. In one embodiment, a support height 2302B of the enclosure support 2397B can vary along an enclosure length 2304B. In another embodiment, the support height 2302B can be substantially constant along the enclosure length 2304B. Further, in the embodiment illustrated in FIG. 23B, the enclosure support 2397B can have a support length 2306B that is shorter than the enclosure length 2304B. Alternatively, the support length 2306B can be equal to the enclosure length 2304B.

Figure 24A:
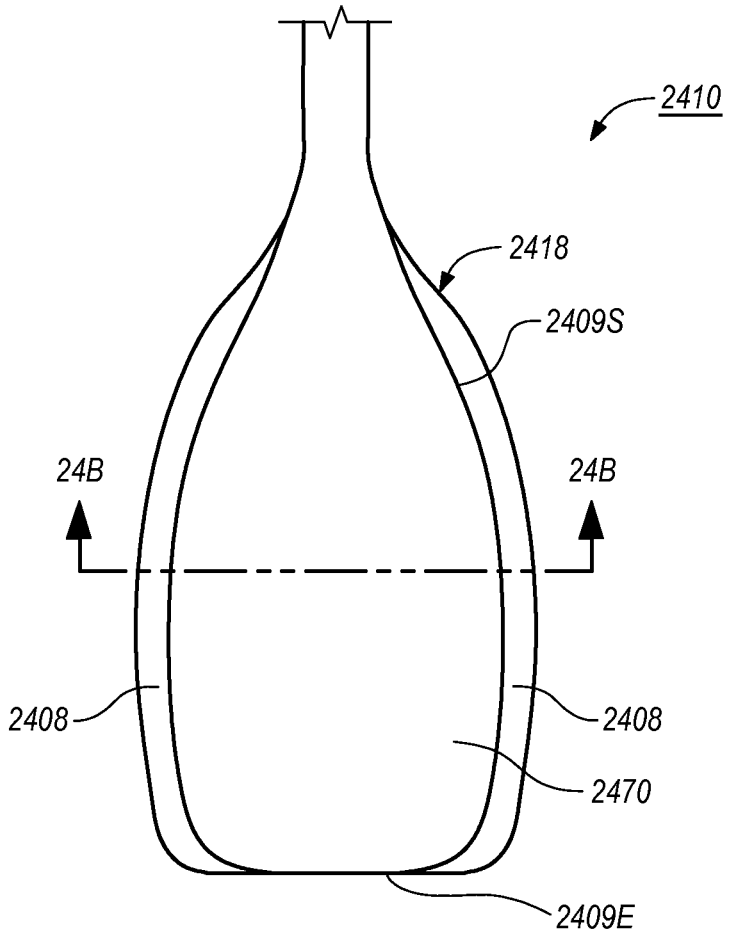
FIG. 24A is a top view of a portion of the paddle assembly including one embodiment of the blade assembly.

FIG. 24A is a top view of a portion of the paddle assembly 2410 including one embodiment of the blade assembly 2418. In this embodiment, the blade assembly 2418 includes a blade body 2470 and one or more fins 2408 (two fins 2408 are illustrated in FIG. 24A) that are secured to the blade body 2470. The fins 2408 provide a greater usable surface area to the blade assembly 2418, while assisting the user throughout the paddle stroke. The blade body 2470 can be formed from relatively rigid materials, as previously described herein. The fins 2408 can be formed from a more resilient or flexible material than the blade body 2470. In one embodiment, the fins 2408 are formed from a rubberized material. Alternatively, the fins 2408 can be formed from another suitable material, such as a flexible plastic, as one non-exclusive example.

In one embodiment, the fins 2408 are positioned on one or more side edges 2409S of the blade body 2470. Alternatively, or additionally, the fin(s) 2408 can be positioned on an end edge 2409E of the blade body 2470. The fins 2408 can be secured to the blade body 2470 by any suitable method, such as by using an appropriate adhesive (not shown), as one non-exclusive example.

Figure 24B:
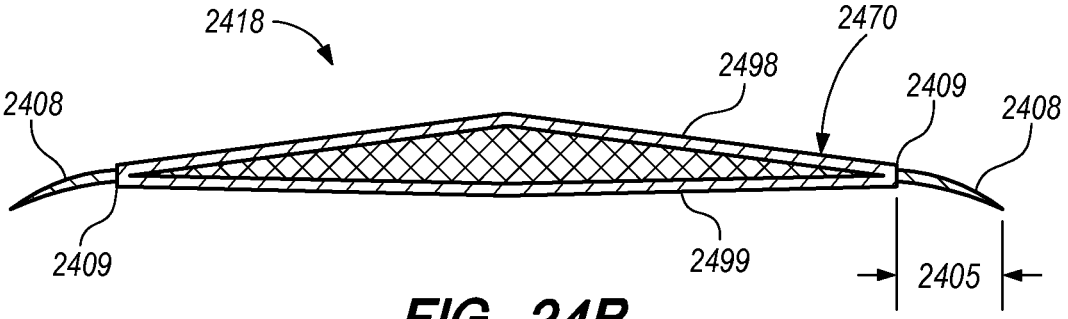
FIG. 24B is a cross-sectional view of the blade assembly taken on line 24B-24B in FIG. 24A.

FIG. 24B is a cross-sectional view of the blade assembly 2418 taken on line 24B-24B in FIG. 24A. The shape and/or configuration of the fins 2408 can vary. In this embodiment, the fins 2408 have a somewhat cupped cross-section in a direction away from a top blade surface 2498. In another embodiment, the fins 2408 can be relatively linear cross-section. Still alternatively, the fins 2408 can have a triangular cross-section. In other embodiments, or the fins 2408 can be angled away from the top blade surface 2498, away from the bottom blade surface 2499, or the fins 2408 can be positioned neither toward nor away from either blade surface 2498, 2499. The fins 2408 can have a fin width 2405 that is substantially uniform, or the fin width 2405 can vary.

Because the fins 2408 are formed from a relatively resilient material, the fins 2408 bend during both insertion and removal of the blade assembly relative to the water (not shown). Initially, the cupping of the fins 2408 create more "grab" by the blade assembly 2418. During the paddle stroke, the fins 2408 tend to be become less cupped. At the end of the paddle stroke, the fins 2408 facilitate removal of the blade assembly 2418 from the water.

It is understood that although a number of different embodiments of the paddle assembly 10 have been illustrated and described herein, one or more features of any one embodiment can be combined with one or more features of one or more of the other embodiment, provided that such combination satisfies the intent of the present invention.

While a number of exemplary aspects and embodiments of the paddle assembly 10 have been shown and disclosed herein above, those of skill in the art will recognize certain modifications, permutations, additions and sub-combinations thereof. It is therefore intended that the system and method shall be interpreted to include all such modifications, permutations, additions and sub-combinations as are within their true spirit and scope, and no limitations are intended to the details of construction or design herein shown.

What is claimed is:

1. A paddle assembly comprising:

a shaft that is configured to be coupled to a blade of the paddle assembly, the shaft having a shaft length, the shaft having an infinite number of different flexural rigidities along the shaft length.

2. The paddle assembly of claim 1, wherein the shaft is formed from materials that include carbon fiber along the entire shaft length.

3. The paddle assembly of claim 1, wherein the shaft is formed as a unitary structure.

4. The paddle assembly of claim 1, wherein the shaft is substantially linear along the entire shaft length.

5. The paddle assembly of claim 1, wherein the shaft has a tubular configuration including an inner diameter that varies by less than approximately 20% along the shaft length.

6. The paddle assembly of claim 1, wherein the shaft has an outer diameter that varies by less than approximately 20% along the shaft length.

7. The paddle assembly of claim 1, wherein the shaft includes a plurality of layers of material that includes carbon fiber, and wherein an orientation of the plurality of layers of material changes along the shaft length.

8. The paddle assembly of claim 1, wherein a modulus of elasticity of the materials used to form the shaft varies continuously along at least a portion of the shaft length.

9. The paddle assembly of claim 1, wherein the flexural rigidity varies along the shaft length by at least approximately 20 percent.

10. The paddle assembly of claim 1, wherein the flexural rigidity varies along the shaft length by at least approximately 70 percent.

11. The paddle assembly of claim 1, wherein the change in the flexural rigidity of the shaft occurs gradually along the shaft length.

12. The paddle assembly of claim 1, wherein the shaft is formed at least partially from carbon nano materials.

13. A paddle assembly comprising:

a shaft that is configured to be coupled to a blade of the paddle assembly, the shaft having a shaft length, the shaft being formed from materials that include carbon fiber along the entire shaft length, the shaft having a flexural rigidity that varies along the shaft length by at least approximately 20 percent.

14. The paddle assembly of claim 13, wherein the shaft is formed as a unitary structure.

15. The paddle assembly of claim 13, wherein the shaft is substantially linear along the entire shaft length.

16. The paddle assembly of claim 13, wherein the shaft has a tubular configuration including an inner diameter that varies by less than approximately 20% along the shaft length.

17. The paddle assembly of claim 13, wherein the shaft has an outer diameter that varies by less than approximately 20% along the shaft length.

18. The paddle assembly of claim 13, wherein the shaft includes a plurality of layers of material that includes carbon fiber, and wherein an orientation of the plurality of layers of material changes along the shaft length.

19. The paddle assembly of claim 13, wherein a modulus of elasticity of the materials used to form the shaft varies continuously along at least a portion of the shaft length.

20. The paddle assembly of claim 13, wherein the flexural rigidity varies along the shaft length by at least approximately 20 percent.

21. The paddle assembly of claim 13, wherein the flexural rigidity varies along the shaft length by at least approximately 70 percent.

22. The paddle assembly of claim 13, wherein the change in the flexural rigidity of the shaft occurs gradually along the shaft length.

23. The paddle assembly of claim 13, wherein the shaft is formed at least partially from carbon nano materials.

24. The paddle assembly of claim 13, wherein the shaft has an infinite number of different flexural rigidities along the shaft length.

25. A paddle assembly comprising:

a shaft that is configured to be coupled to a blade of the paddle assembly, the shaft having a shaft length, the shaft being formed from materials that include carbon fiber along the entire shaft length, the shaft having an outer diameter that varies by less than approximately 20% along the shaft length, the shaft having an infinite number of different flexural rigidities along the shaft length, and the shaft having a flexural rigidity that varies along the shaft length by at least approximately 20 percent.

26. The paddle assembly of claim 25, wherein the shaft is formed as a unitary structure.

27. The paddle assembly of claim 25, wherein the shaft has a tubular configuration including an inner diameter that varies by less than approximately 20% along the shaft length.

* * * * *